US011242727B2

(12) United States Patent
Watson et al.

(10) Patent No.: US 11,242,727 B2
(45) **Date of Patent: *Feb. 8, 2022**

(54) FLOW CONTROL IN SUBTERRANEAN WELLS

(71) Applicant: THRU TUBING SOLUTIONS, INC., Oklahoma City, OK (US)

(72) Inventors: Brock W. Watson, Sadler, TX (US); Gary P. Funkhouser, Moore, OK (US); Roger L. Schultz, Newcastle, OK (US); Andrew M. Ferguson, Moore, OK (US)

(73) Assignee: Thru Tubing Solutions, Inc., Newcastle, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/987,094

(22) Filed: Aug. 6, 2020

(65) Prior Publication Data

US 2020/0362663 A1 Nov. 19, 2020

Related U.S. Application Data

(63) Continuation of application No. 15/615,136, filed on Jun. 6, 2017, now Pat. No. 10,774,612, which is a (Continued)

(51) Int. Cl.
*E21B 33/138* (2006.01)
*E21B 43/26* (2006.01)

(52) U.S. Cl.
CPC ..... *E21B 33/138* (2013.01); *E21B 43/26* (2013.01); *E21B 43/261* (2013.01); *E21B 2200/01* (2020.05)

(58) Field of Classification Search
CPC .... E21B 33/13; E21B 33/134; E21B 2200/01; E21B 33/1208; E21B 2201/01
(Continued)

(56) References Cited

U.S. PATENT DOCUMENTS 2,157,493 A 5/1939 Miller et al.
2,370,833 A 3/1945 Baker
(Continued)

FOREIGN PATENT DOCUMENTS

WO 199111587 A1 8/1991
WO 2007066254 A2 7/2007
(Continued)

OTHER PUBLICATIONS

Definition by Merriam-Webster, Fuse, retrieved Apr. 22, 2021 from https://www.merriam-webster.com/dictionary/fuse?utm_campaign=sd&utm_medium=serp&utm_source=jsonld (Year: 2021).*
(Continued)

*Primary Examiner* — Angela M DiTrani Leff
(74) *Attorney, Agent, or Firm* — Smith IP Services, P.C.

(57) ABSTRACT

A plugging device, well system and method. In one example, a wrap, band or other type of binding is utilized to secure together multiple fibers, tubes, filaments, films, fabrics or lines of the plugging device. In another example, fibers, tubes, filaments, films, fabrics or lines are fused, adhered or bonded to an outer surface of a body of the plugging device. In other examples, a material of the plugging device may become more rigid or swell in a well. A plugging device may comprise a body loosely enclosed in a bag, wrapper or other enclosure.

34 Claims, 23 Drawing Sheets

Related U.S. Application Data continuation-in-part of application No. 15/609,671, filed on May 31, 2017, and a continuation-in-part of application No. 15/390,941, filed on Dec. 27, 2016, now Pat. No. 10,738,564, and a continuation-in-part of application No. 15/390,976, filed on Dec. 27, 2016, now Pat. No. 10,738,565, and a continuation-in-part of application No. 15/391,014, filed on Dec. 27, 2016, now Pat. No. 10,738,566, and a continuation-in-part of application No. 15/347,535, filed on Nov. 9, 2016, now Pat. No. 10,641,070, and a continuation-in-part of application No. 15/296,342, filed on Oct. 18, 2016, now Pat. No. 9,816,341, and a continuation-in-part of application No. PCT/US2016/029314, filed on Apr. 26, 2016, and a continuation-in-part of application No. 15/138,685, filed on Apr. 26, 2016, now Pat. No. 10,233,719, and a continuation-in-part of application No. 15/138,449, filed on Apr. 26, 2016, now Pat. No. 9,708,883, and a continuation-in-part of application No. 15/138,968, filed on Apr. 26, 2016, now Pat. No. 9,745,820, and a continuation-in-part of application No. 14/698,578, filed on Apr. 28, 2015, now Pat. No. 10,641,069.

(60) Provisional application No. 62/416,567, filed on Nov. 2, 2016.

(58) Field of Classification Search
USPC ..... 166/192, 193
See application file for complete search history.

(56) References Cited

U.S. PATENT DOCUMENTS 2,621,351 A 12/1952 Piety
2,754,910 A 7/1956 Derrick et al.
2,768,693 A 10/1956 Hughes, Jr.
2,788,072 A 4/1957 Goodwin
2,838,117 A 6/1958 Clark, Jr. et al.
2,933,136 A 4/1960 Ayers
2,970,645 A 2/1961 Glass
3,011,548 A 12/1961 Holt
3,028,914 A 4/1962 Flickinger
3,086,587 A 4/1963 Zandmer et al.
3,119,600 A 1/1964 Bitter
3,144,049 A 8/1964 Ginsburgh
3,170,517 A 2/1965 Graham et al.
3,174,546 A 3/1965 Flickinger
3,251,993 A 5/1966 Bader
3,292,700 A 12/1966 Berry
3,376,934 A * 4/1968 William ..... E21B 33/138 166/193
3,399,726 A 9/1968 Harris et al.
3,417,821 A 12/1968 Tinsley et al.
3,434,539 A 3/1969 Merrit
3,437,147 A 4/1969 Davies
3,595,314 A 7/1971 Garner
3,707,194 A 12/1972 Svaldi
3,814,187 A 6/1974 Holamn
3,837,214 A 9/1974 Guest
3,895,678 A 7/1975 Wright et al.
4,167,139 A 9/1979 Gleason et al.
4,187,909 A 2/1980 Erbstoesser
4,191,561 A 3/1980 Quinlan et al.
4,194,561 A 3/1980 Stokley et al.
4,244,425 A 1/1981 Erbstoesser
2,109,058 A 2/1983 Blee
4,407,368 A 10/1983 Erbstoesser
4,505,334 A 3/1985 Doner et al.
4,628,994 A 12/1986 Towner et al.
4,716,964 A 1/1988 Erbstoesser et al.
4,921,577 A 5/1990 Eubank
4,924,811 A 5/1990 Axelrod
5,052,220 A 10/1991 Piers
5,052,489 A 10/1991 Carisella et al.
5,253,709 A 10/1993 Kendrick et al.
5,272,646 A 12/1993 Farmer
5,477,815 A 12/1995 O'Rourke
5,507,345 A 4/1996 Wehunt, Jr. et al.
5,890,536 A 4/1999 Nierode et al.
5,908,073 A * 6/1999 Nguyen ..... E21B 43/267 166/276
6,070,666 A 6/2000 Montgomery
6,394,184 B2 5/2002 Tolman et al.
6,427,776 B1 8/2002 Hoffman et al.
6,543,538 B2 4/2003 Tolman et al.
6,655,475 B1 12/2003 Wald
6,931,952 B2 8/2005 Rantala et al.
6,973,966 B2 12/2005 Szarka
7,225,869 B2 6/2007 Willet et al.
7,273,099 B2 9/2007 East, Jr. et al.
7,364,051 B2 4/2008 Diaz et al.
7,451,823 B2 11/2008 Wilson
7,527,095 B2 5/2009 Bloess et al.
7,559,363 B2 7/2009 Howell et al.
7,624,810 B2 12/2009 Fould et al.
7,673,673 B2 3/2010 Surjaatmadja et al.
7,673,688 B1 5/2010 Jones et al.
7,748,452 B2 7/2010 Sullivan et al.
7,810,523 B2 10/2010 McEwan et al.
7,810,567 B2 10/2010 Daniels et al.
7,874,365 B2 1/2011 East, Jr. et al.
7,891,424 B2 2/2011 Creel et al.
8,088,717 B2 1/2012 Polizzotti et al.
8,240,392 B2 8/2012 Bernard et al.
8,256,515 B2 9/2012 Barbee
8,281,860 B2 10/2012 Boney et al.
8,307,916 B1 11/2012 Wald
8,397,820 B2 3/2013 Fehr et al.
8,505,632 B2 8/2013 Guerrero et al.
8,561,696 B2 10/2013 Trummer et al.
8,596,362 B2 12/2013 Nelson
8,646,529 B2 2/2014 Clark et al.
8,757,260 B2 6/2014 Luo et al.
8,776,886 B2 7/2014 Rondeau et al.
8,851,172 B1 * 10/2014 Dudzinski ..... E21B 33/138 166/284
8,853,137 B2 10/2014 Todd et al.
8,887,803 B2 11/2014 East, Jr. et al.
8,950,437 B2 2/2015 Ryan et al.
8,950,438 B2 2/2015 Ryan
8,950,491 B2 2/2015 Frost
9,187,975 B2 11/2015 Rochen
9,284,798 B2 3/2016 Jamison et al.
9,334,704 B2 5/2016 Mineo et al.
9,523,267 B2 * 12/2016 Schultz ..... E21B 43/12
9,551,204 B2 * 1/2017 Schultz ..... E21B 33/138
9,567,824 B2 * 2/2017 Watson ..... E21B 33/13
9,567,825 B2 * 2/2017 Schultz ..... E21B 43/26
9,567,826 B2 * 2/2017 Schultz ..... E21B 33/13
9,708,883 B2 * 7/2017 Schultz ..... E21B 43/263
9,745,820 B2 * 8/2017 Watson ..... E21B 33/13
9,784,004 B2 * 10/2017 Ervin ..... E04G 23/0218
9,816,341 B2 11/2017 Funkhouser et al.
9,863,569 B2 1/2018 Czaplewski et al.
9,920,589 B2 3/2018 Watson et al.
10,233,719 B2 * 3/2019 Schultz ..... E21B 33/13
10,513,653 B2 * 12/2019 Schultz ..... C09K 8/62
10,513,902 B2 * 12/2019 Funkhouser ..... E21B 43/26
10,641,057 B2 * 5/2020 Schultz ..... E21B 33/138
10,641,069 B2 * 5/2020 Schultz ..... E21B 33/13
10,641,070 B2 * 5/2020 Schultz ..... E21B 33/138
10,655,427 B2 * 5/2020 Schultz ..... E21B 33/1208
10,738,564 B2 * 8/2020 Watson ..... E21B 33/13
10,738,565 B2 * 8/2020 Schultz ..... E21B 33/13
10,738,566 B2 * 8/2020 Schultz ..... E21B 33/13
10,753,174 B2 8/2020 Watson et al.
10,767,442 B2 * 9/2020 Schultz ..... E21B 33/13
10,774,612 B2 9/2020 Watson et al.
10,851,283 B2 * 12/2020 Potapenko ..... C09K 8/02
10,851,615 B2 * 12/2020 Watson ..... E21B 23/08

(56) References Cited

U.S. PATENT DOCUMENTS

| | | | |
|---|---|---|---|
| 10,900,312 | B2 | 1/2021 | Funkhouser et al. |
| 10,907,430 | B2 | 2/2021 | Funkhouser et al. |
| 11,022,248 | B2 | 6/2021 | Tolman et al. |
| 2003/0121338 | A1 | 7/2003 | Yates |
| 2003/0160391 | A1 | 8/2003 | McEwan |
| 2004/0129460 | A1 | 7/2004 | MacQuoid et al. |
| 2004/0261990 | A1 | 12/2004 | Boseman et al. |
| 2005/0184083 | A1 | 8/2005 | Diaz et al. |
| 2005/0230117 | A1 | 10/2005 | Wilkinson |
| 2005/0284530 | A1 | 12/2005 | McEwan et al. |
| 2006/0102336 | A1 | 5/2006 | Campbell |
| 2006/0113077 | A1 | 6/2006 | Willberg et al. |
| 2006/0169449 | A1 | 8/2006 | Mang et al. |
| 2006/0213662 | A1 | 9/2006 | Creel et al. |
| 2006/0278281 | A1 | 12/2006 | Gynz-Rekowski et al. |
| 2007/0039739 | A1 | 2/2007 | Wilson |
| 2007/0169935 | A1 | 7/2007 | Akbar et al. |
| 2007/0187099 | A1 | 8/2007 | Wang |
| 2008/0000639 | A1 | 1/2008 | Clark et al. |
| 2008/0093073 | A1 | 4/2008 | Bustos et al. |
| 2008/0128133 | A1 | 6/2008 | Turley et al. |
| 2008/0196896 | A1 | 8/2008 | Bustos et al. |
| 2008/0200352 | A1 | 8/2008 | Willberg et al. |
| 2010/0122813 | A1 | 5/2010 | Trummer et al. |
| 2010/0147866 | A1 | 6/2010 | Witkowski et al. |
| 2010/0152070 | A1 | 6/2010 | Ghassemzadeh |
| 2010/0175889 | A1 | 7/2010 | Gartz et al. |
| 2010/0200235 | A1 | 8/2010 | Luo et al. |
| 2010/0307747 | A1 | 12/2010 | Shindgikar et al. |
| 2011/0048712 | A1 | 3/2011 | Barbee |
| 2011/0226479 | A1 | 9/2011 | Tippel et al. |
| 2011/0297396 | A1 | 12/2011 | Hendel et al. |
| 2012/0013893 | A1 | 1/2012 | Maida et al. |
| 2012/0031614 | A1 | 2/2012 | Rondeau et al. |
| 2012/0067581 | A1 | 3/2012 | Auzerais et al. |
| 2012/0085548 | A1 | 4/2012 | Fleckenstein et al. |
| 2012/0090835 | A1 | 4/2012 | Kefi |
| 2012/0181032 | A1 | 7/2012 | Naedler et al. |
| 2012/0234538 | A1 | 9/2012 | Martin et al. |
| 2012/0235438 | A1 | 9/2012 | Martin et al. |
| 2012/0285695 | A1 | 11/2012 | Lafferty et al. |
| 2013/0062055 | A1 | 3/2013 | Tolman et al. |
| 2013/0098600 | A1 | 4/2013 | Roberts |
| 2013/0186632 | A1 | 7/2013 | Makowiecki et al. |
| 2013/0233553 | A1 | 9/2013 | Bugrin et al. |
| 2013/0292123 | A1 | 11/2013 | Murphree et al. |
| 2013/0327528 | A1 | 12/2013 | Frost |
| 2014/0022537 | A1 | 1/2014 | Samson et al. |
| 2014/0116712 | A1 | 5/2014 | Bansal et al. |
| 2014/0151052 | A1 | 6/2014 | Themig et al. |
| 2014/0231086 | A1 | 8/2014 | Jamison et al. |
| 2014/0274815 | A1 | 9/2014 | Lovett et al. |
| 2014/0299334 | A1* | 10/2014 | Hallundbæk ..... E21B 33/1208 166/387 |
| 2014/0332231 | A1* | 11/2014 | Themig ..... E21B 34/14 166/373 |
| 2014/0374106 | A1 | 12/2014 | Zhu et al. |
| 2015/0060069 | A1* | 3/2015 | Potapenko ..... E21B 33/138 166/284 |
| 2015/0060072 | A1 | 3/2015 | Busby et al. |
| 2015/0075793 | A1 | 3/2015 | Dotson et al. |
| 2015/0083423 | A1 | 3/2015 | Brannon et al. |
| 2015/0090453 | A1 | 4/2015 | Tolman et al. |
| 2015/0122364 | A1 | 5/2015 | Cheatham, III et al. |
| 2015/0129214 | A1* | 5/2015 | Boney ..... E21B 33/138 166/284 |
| 2015/0191988 | A1 | 7/2015 | Kiesel et al. |
| 2015/0240583 | A1 | 8/2015 | Mineo et al. |
| 2015/0275644 | A1 | 10/2015 | Chen et al. |
| 2015/0284879 | A1 | 10/2015 | Takahashi et al. |
| 2016/0040520 | A1 | 2/2016 | Tolman et al. |
| 2016/0053503 | A1* | 2/2016 | Ervin ..... E04G 23/0218 52/741.3 |
| 2016/0130933 | A1 | 5/2016 | Madasu |
| 2016/0237767 | A1 | 6/2016 | Snoswell et al. |
| 2016/0251930 | A1 | 9/2016 | Jacob et al. |
| 2016/0319628 | A1 | 11/2016 | Schultz et al. |
| 2016/0319630 | A1 | 11/2016 | Watson et al. |
| 2016/0319631 | A1 | 11/2016 | Schultz et al. |
| 2016/0319632 | A1 | 11/2016 | Watson et al. |
| 2016/0348465 | A1 | 12/2016 | Schultz et al. |
| 2016/0348466 | A1 | 12/2016 | Schultz et al. |
| 2016/0348467 | A1 | 12/2016 | Schultz et al. |
| 2017/0030169 | A1 | 2/2017 | Funkhouser et al. |
| 2017/0107784 | A1 | 4/2017 | Watson et al. |
| 2017/0107786 | A1 | 4/2017 | Schultz et al. |
| 2017/0260828 | A1 | 9/2017 | Watson et al. |
| 2017/0275961 | A1 | 9/2017 | Schultz et al. |
| 2017/0275965 | A1 | 9/2017 | Watson et al. |
| 2017/0335651 | A1 | 11/2017 | Watson et al. |
| 2018/0127644 | A1* | 5/2018 | Xiang ..... C09K 8/92 |
| 2018/0135394 | A1 | 5/2018 | Tolman |
| 2018/0245439 | A1 | 8/2018 | Entchev et al. |

FOREIGN PATENT DOCUMENTS

| | | | |
|---|---|---|---|
| WO | 2013184238 | A1 | 12/2013 |
| WO | 2014042552 | A1 | 3/2014 |
| WO | 2014099206 | A1 | 6/2014 |
| WO | 2016175876 | A1 | 11/2016 |
| WO | 2016176181 | A1 | 11/2016 |
| WO | 2017070105 | A1 | 4/2017 |

OTHER PUBLICATIONS

International Search Report with Written Opinion dated Jan. 26, 2016 for PCT Patent Application No. PCT/US15/038248, 16 pages.

Office Action dated Apr. 13, 2016 for U.S. Appl. No. 14/698,578, 27 pages.

Office Action dated Apr. 13, 2016 for U.S. Appl. No. 14/966,812, 27 pages.

"Fabric." Merriam-Webster.com. Merriam-Webster, n.d. Web. Apr. 5, 2016, 6 pages.

"Rope." Merriam-Webster.com. Merriam-Webster, n.d. Web. Apr. 5, 2016, 10 pages.

Office Action dated Oct. 17, 2016 for U.S. Appl. No. 15/138,968, 32 pages.

Office Action dated Jul. 11, 2016 for U.S. Appl. No. 15/062,669, 26 pages.

Office Action dated Jul. 18, 2016 for U.S. Appl. No. 14/966,812, 22 pages.

Office Action dated Jul. 18, 2016 for U.S. Appl. No. 15/138,408, 26 pages.

Office Action dated Jul. 20, 2016 for U.S. Appl. No. 15/138,327, 29 pages.

Office Action dated Jul. 20, 2016 for U.S. Appl. No. 15/138,378, 25 pages.

Merriam Webster, "Bundle", web page, retrieved Jul. 5, 2016 from www.merriam-webster.com/dictionary/bundle, 7 pages.

thefreedictionary.com; "Threaded", online dictionary definition, dated Sep. 15, 2016, 5 pages.

Specification and drawings for Patent Application No. PCT/US16/29357 filed Apr. 26, 2016, 50 pages.

Merriam-Webster, "Filament", web page, retrieved Aug. 12, 2016 from www.merriam-webster.com/dictionary/filament, 4 pages.

Monosol; "Film Data Sheet", product information brochure, dated Mar. 6, 2012, 1 page.

Merriam-Webster, "Lateral", web page, retrieved Aug. 12, 2016 from www.merriam-webster.com/dictionary/lateral, 5 pages.

Wikipedia, "Nylon 6", web page, retrieved Aug. 12, 2016 from https://en.wikipedia.org/wiki/Nylon_6, 4 pages.

Wolfram Research, "Drag Coefficient", web page, retrieved Aug. 12, 2016 from http://scienceworld.wolfram.com/physics/DragCoefficient.html, 1 page.

International Search Report with Written Opinion dated Aug. 18, 2016 for PCT Patent Application No. PCT/US2016/029314, 18 pages.

(56) References Cited

OTHER PUBLICATIONS

International Search Report with Written Opinion dated Aug. 17, 2016 for PCT Patent Application No. PCT/US2016/029357, 18 pages.
Specification and drawings for U.S. Appl. No. 15/296,342, filed Oct. 18, 2016, 120 pages.
Specification and drawings for PCT Patent Application No. PCT/US16/57514, filed Oct. 18, 2016, 120 pages.
Office Action dated Oct. 13, 2016 for U.S. Appl. No. 15/138,449, 35 pages.
Office Action dated Oct. 20, 2016 for U.S. Appl. No. 15/138,327, 23 pages.
Office Action dated Oct. 20, 2016 for U.S. Appl. No. 15/138,685, 35 pages.
Office Action dated Nov. 2, 2016 for U.S. Appl. No. 14/698,578, 28 pages.
Raghavendra R. Hegde, et al.; "Nylon Fibers", online article, dated Apr. 2004, 8 pages.
Office Action dated Apr. 13, 2017 for U.S. Appl. No. 15/162,334, 26 pages.
thefreedictionary.com; "Thread", online dictionary definition, dated Feb. 16, 2017, 12 pages.
Office Action dated May 5, 2017 for U.S. Appl. No. 15/347,535, 20 pages.
Office Action dated May 9, 2017 for U.S. Appl. No. 15/138,685, 42 pages.
Office Action dated May 12, 2017 for U.S. Appl. No. 15/296,342, 23 pages.
Canadian Office Action dated Dec. 13, 2017 for CA Patent Application No. 2,957,681, 3 pages.
Specification and drawings for U.S. Appl. No. 15/745,608, filed Jan. 17, 2018, 56 pages.
Australian Examination Report dated Jan. 18, 2018 for AU Patent Application No. 2015393421, 3 pages.
Examiner's Report dated Mar. 28, 2018 for U.S. Appl. No. 15/390,976, 10 pages.
Examiner's Report dated Mar. 28, 2018 for U.S. Appl. No. 15/391,014, 14 pages.
Office Action dated Mar. 29, 2018 for U.S. Appl. No. 15/622,016, 28 pages.
Office Action dated Apr. 20, 2018 for U.S. Appl. No. 15/138,685, 27 pages.
GCC Examination Report dated May 28, 2018 for GCC Patent Application No. 2016-31218, 4 pages.
GCC Examination Report dated May 28, 2018 for GCC Patent Application No. 2016-31220, 4 pages.
GCC Examination Report dated May 27, 2018 for GCC Patent Application No. 2016-31217, 4 pages.
GCC Examination Report dated May 27, 2018 for GCC Patent Application No. 2016-31216, 4 pages.
International Search Report with Written Opinion dated Aug. 1, 2018 for PCT Patent Application No. PCT/US2018/029395, 20 pages.
International Search Report with Written Opinion dated Aug. 2, 2018 for PCT Patent Application No. PCT/US2018/029383, 20 pages.
GCC Examination Report dated Jun. 3, 2018 for GCC Patent Application No. 2016-31222, 4 pages.
Office Action dated Jul. 18, 2017 for U.S. Appl. No. 15/390,941, 27 pages.
Office Action dated Jul. 14, 2017 for U.S. Appl. No. 15/391,014, 24 pages.
Office Action dated Jul. 11, 2017 for U.S. Appl. No. 15/622,016, 16 pages.
Office Action dated Jul. 17, 2017 for U.S. Appl. No. 15/138,685, 21 pages.
Office Action dated Jul. 20, 2017 for U.S. Appl. No. 15/162,334, 18 pages.
"Yarn"; Definition of Yarn by Merriam-Webster.com, Merriam-Webster, n.d. Web., Aug. 11, 2017, 6 pages.
Office Action dated Aug. 16, 2017 for U.S. Appl. No. 14/698,578, 9 pages.
Office Action dated Aug. 16, 2017 for U.S. Appl. No. 15/390,976, 25 pages.
International Search Report with Written Opinion dated Aug. 25, 2017 for PCT Patent Application No. PCT/US2017/036090, 37 pages.
Specification and Drawings for U.S. Appl. No. 15/567,779, filed Oct. 19, 2017, 63 pages.
Office Action dated Nov. 3, 2017 for U.S. Appl. No. 15/138,685, 15 pages.
Office Action dated Nov. 7, 2017 for U.S. Appl. No. 15/162,334, 16 pages.
Office Action dated Nov. 13, 2017 for U.S. Appl. No. 15/622,016, 44 pages.
Examiner's Answer dated Nov. 15, 2017 for U.S. Appl. No. 15/347,535, 14 pages.
Office Action dated Jun. 11, 2018 for U.S. Appl. No. 15/658,697, 52 pages.
Canadian Office Action dated Nov. 23, 2018 for CA Patent Application No. 2,995,533, 4 pages.
Australian Examination Report dated Nov. 14, 2018 for AU Patent Application No. 2017218948, 5 pages.
Australian Examination Report dated Nov. 7, 2018 for AU Patent Application No. 2017219082, 5 pages.
Canadian Office Action dated Oct. 16, 2018 for CA Patent Application No. 2,992,712, 5 pages.
Australian Examination Report dated Dec. 18, 2019 for AU Patent Application No. 2017347510, 8 pages.
Canadian Office Action dated Dec. 9, 2019 for CA Patent Application No. 3,019,772, 4 pages.
Office Action dated Sep. 21, 2020 for U.S. Appl. No. 16/597,183, 60 pages.
Office Action dated Oct. 2, 2020 for U.S. Appl. No. 16/264,758, 9 pages.
GCC Examination Report dated Dec. 24, 2018 for GCC Patent Application No. 2016-31224, 4 pages.
Australian Examination Report dated Feb. 18, 2019 for AU Patent Application No. 2017219082, 3 pages.
GCC Examination Report dated Dec. 24, 2018 for GCC Patent Application No. 2016-31223, 4 pages.
Office Action dated Jan. 29, 2019 for U.S. Appl. No. 15/622,016, 22 pages.
Australian Examination Report dated Feb. 18, 2019 for AU Patent Application No. 2017279758, 3 pages.
Office Action dated Feb. 4, 2019 for U.S. Appl. No. 15/567,779, 58 pages.
Office Action dated Feb. 11, 2019 for U.S. Appl. No. 16/214,174, 17 pages.
Office Action dated Feb. 11, 2019 for U.S. Appl. No. 16/238,838, 25 pages.
Australian Examination Report dated Feb. 26, 2019 for AU Patent Application No. 2017276220, 4 pages.
Office Action dated Mar. 18, 2019 for U.S. Appl. No. 15/658,697, 34 pages.
Office Action dated Mar. 18, 2019 for U.S. Appl. No. 15/726,160, 62 pages.
GCC Examination Report dated Dec. 23, 2018 for GCC Patent Application No. 2016-31222, 4 pages.
Perf Sealers; "History of Perforation Ball Sealers in the Oil and Gas Industry", company website article, dated 2014-2019, 4 pages.
Office Action dated Mar. 20, 2019 for U.S. Appl. No. 15/432,041, 39 pages.
Examination Report dated Dec. 24, 2018 for GCC Patent Application No. 2016-31224, 4 pages.
Examination Report dated Apr. 2, 2019 for GCC Patent Application No. 2016-31243, 4 pages.
Examination Report dated Mar. 2, 2019 for GCC Patent Application No. 2016-31242, 4 pages.
Oxford Dictionaries; "body", definition of body in English, dated May 23, 2019, 7 pages.
Office Action dated May 29, 2019 for U.S. Appl. No. 15/567,779, 18 pages.

(56) References Cited

OTHER PUBLICATIONS

Office Action dated May 29, 2019 for U.S. Appl. No. 16/214,174, 26 pages.
Examination Report dated Mar. 11, 2019 for GCC Patent Application No. 2016-32206, 5 pages.
Examination Report dated Feb. 12, 2019 for GCC Patent Application No. 2017-33854, 5 pages.
Office Action dated Apr. 19, 2019 for U.S. Appl. No. 15/609,671, 23 pages.
Canadian Office Action dated Apr. 11, 2019 for CA Patent Application No. 2,992,712, 4 pages.
Specifications and drawings for U.S. Appl. No. 16/402,396, filed May 3, 2019, 93 pages.
Australian Examination Report dated Nov. 2, 2018 for AU Patent Application No. 2017219089, 5 pages.
Canadian Office Action dated Nov. 30, 2018 for CA Patent Application No. 2,957,681, 3 pages.
Office Action dated Dec. 13, 2018 for U.S. Appl. No. 15/390,941, 11 pages.
Australian Examination Report dated Nov. 21, 2018 for AU Patent Application No. 2017216597, 5 pages.
Office Action dated Jan. 14, 2019 for U.S. Appl. No. 15/609,671, 66 pages.
Australian Examination Report dated Jul. 11, 2018 for AU Patent Application No. 53026THR/MRR, 3 pages.
GCC Examination Report dated Jul. 18, 2018 for GCC Patent Application No. GC 2016-31224, 4 pages.
GCC Examination Report dated Jul. 18, 2018 for GCC Patent Application No. GC 2016-31223, 4 pages.
Office Action dated Oct. 9, 2018 for U.S. Appl. No. 15/658,697, 24 pages.
Office Action dated Jan. 1, 2021 for U.S. Appl. No. 16/500,805, 34 pages.
Office Action dated Sep. 16, 2019 for U.S. Appl. No. 15/609,671, 39 pages.
Office Action dated Sep. 23, 2019 for U.S. Appl. No. 16/214,174, 26 pages.
Lexico Dictionary; "body", Definition of body in English, dated Sep. 17, 2019, 7 pages.
Lexico Dictionary; "knot", Main definitions of knot in English, dated Sep. 17, 2019, 8 pages.
Examiner's Answer dated Sep. 25, 2019 for U.S. Appl. No. 15/658,697, 26 pages.
Office Action dated Oct. 11, 2019 for U.S. Appl. No. 15/567,779, 33 pages.
Office Action dated Oct. 23, 2019 for U.S. Appl. No. 15/745,608, 69 pages.
Office Action dated Jul. 3, 2019 for U.S. Appl. No. 15/726,160, 17 pages.
GCC Examination Report dated Jun. 17, 2019 for GCC Patent Application No. 2016-36182, 3 pages.
Canadian Office Action dated Aug. 2, 2019 for CA Patent Application No. 3,019,772, 5 pages.
Office Action dated Jul. 13, 2017 for U.S. Appl. No. 15/615,136, 13 pages.
Office Action dated Nov. 13, 2017 for U.S. Appl. No. 15/615,136, 34 pages.
Office Action dated Mar. 30, 2018 for U.S. Appl. No. 15/615,136, 28 pages.
Office Action dated Jul. 20, 2018 for U.S. Appl. No. 15/615,136, 14 pages.
Office Action dated Dec. 11, 2018 for U.S. Appl. No. 15/615,136, 37 pages.
Office Action dated Jun. 18, 2021 for U.S. Appl. No. 16/603,921, 57 pages.
Examiner's Answer dated Jun. 25, 2021 for U.S. Appl. No. 16/597,183, 23 pages.
Notice of Allowance dated Mar. 18, 2021 for U.S. Appl. No. 15/658,697, 34 pages.
Office Action dated Sep. 1, 2021 for U.S. Appl. No. 16/931,322, 11 pages.
Argentina Office Action dated Apr. 28, 2021 for AR Patent Application No. 2017 01 01972, 6 pages.

* cited by examiner

FLOW CONTROL IN SUBTERRANEAN WELLS

CROSS-REFERENCE TO RELATED APPLICATIONS

The present application is a continuation of U.S. application Ser. No. 15/615,136 (filed 6 Jun. 2017), which claims the benefit of the filing date of U.S. provisional application Ser. No. 62/416,567 (filed 2 Nov. 2016), and is a continuation-in-part of each of U.S. application serial nos. Ser. No. 14/698,578 (filed 28 Apr. 2015), Ser. No. 15/347,535 (filed 9 Nov. 2016), Ser. No. 15/390,941 (filed 27 Dec. 2016), Ser. No. 15/390,976 (filed 27 Dec. 2016), Ser. No. 15/391,014 (filed 27 Dec. 2016), Ser. No. 15/138,449 (filed 26 Apr. 2016), Ser. No. 15/138,685 (filed 26 Apr. 2016), Ser. No. 15/138,968 (filed 26 Apr. 2016), Ser. No. 15/296,342 (filed 18 Oct. 2016) Ser. No. 15/609671 (filed 31 May 2017), and International application serial no. PCT/US16/29314 (filed 26 Apr. 2016). The entire disclosures of these prior applications are incorporated herein in their entireties by this reference.

BACKGROUND

This disclosure relates generally to equipment utilized and operations performed in conjunction with a subterranean well and, in one example described below, more particularly provides for plugging devices and their deployment in wells.

It can be beneficial to be able to control how and where fluid flows in a well. For example, it may be desirable in some circumstances to be able to prevent fluid from flowing into a particular formation zone. As another example, it may be desirable in some circumstances to cause fluid to flow into a particular formation zone, instead of into another formation zone. As yet another example, it may be desirable to temporarily prevent fluid from flowing through a passage of a well tool. Therefore, it will be readily appreciated that improvements are continually needed in the art of controlling fluid flow in wells.

DETAILED DESCRIPTION

Figure 1:
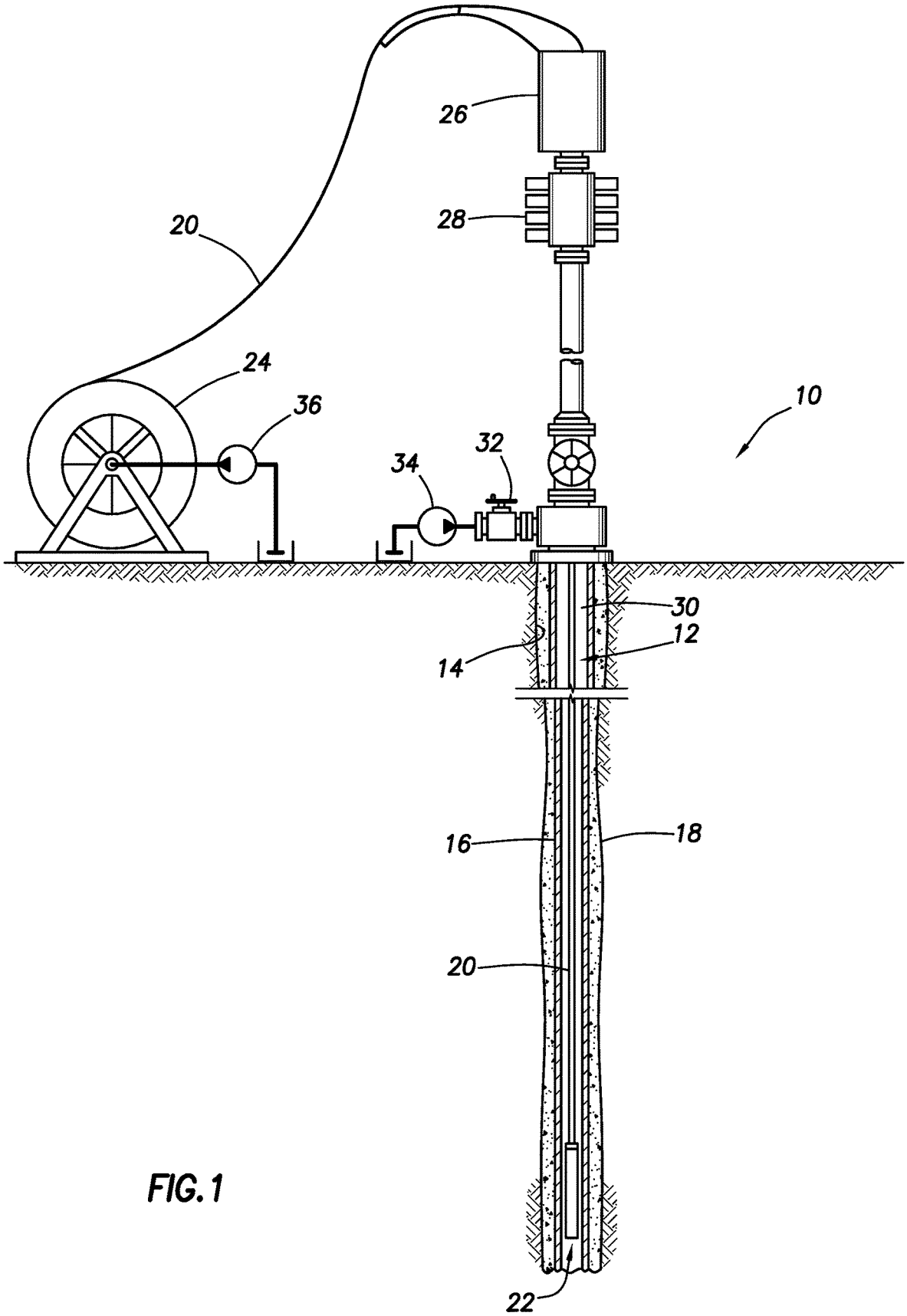
FIG. 1 is a representative partially cross-sectional view of an example of a well system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is conveyed into a wellbore 14 lined with casing 16 and cement 18. Although multiple casing strings would typically be used in actual practice, for clarity of illustration only one casing string 16 is depicted in the drawings.

Although the wellbore 14 is illustrated as being vertical, sections of the wellbore could instead be horizontal or otherwise inclined relative to vertical. Although the wellbore 14 is completely cased and cemented as depicted in FIG. 1, any sections of the wellbore in which operations described in more detail below are performed could be uncased or open hole. Thus, the scope of this disclosure is not limited to any particular details of the system 10 and method.

The tubular string 12 of FIG. 1 comprises coiled tubing 20 and a bottom hole assembly 22. As used herein, the term "coiled tubing" refers to a substantially continuous tubing that is stored on a spool or reel 24. The reel 24 could be mounted, for example, on a skid, a trailer, a floating vessel, a vehicle, etc., for transport to a wellsite. Although not shown in FIG. 1, a control room or cab would typically be provided with instrumentation, computers, controllers, recorders, etc., for controlling equipment such as an injector 26 and a blowout preventer stack 28.

As used herein, the term "bottom hole assembly" refers to an assembly connected at a distal end of a tubular string in a well. It is not necessary for a bottom hole assembly to be positioned or used at a "bottom" of a hole or well.

When the tubular string 12 is positioned in the wellbore 14, an annulus 30 is formed radially between them. Fluid, slurries, etc., can be flowed from surface into the annulus 30 via, for example, a casing valve 32. One or more pumps 34 may be used for this purpose. Fluid can also be flowed to surface from the wellbore 14 via the annulus 30 and valve 32.

Fluid, slurries, etc., can also be flowed from surface into the wellbore 14 via the tubing 20, for example, using one or more pumps 36. Fluid can also be flowed to surface from the wellbore 14 via the tubing 20.

In the further description below of the examples of FIGS. 2A-14, one or more flow conveyed plugging devices are used to block or plug openings in the system 10 of FIG. 1. However, it should be clearly understood that these methods and the flow conveyed device may be used with other systems, and the flow conveyed device may be used in other methods in keeping with the principles of this disclosure.

The example methods described below allow existing fluid passageways to be blocked permanently or temporarily in a variety of different applications. Certain flow conveyed device examples described below are made of a fibrous material and may comprise a central body, a "knot" or other enlarged geometry.

The plugging devices may be conveyed into the passageways or leak paths to be plugged using pumped fluid. Fibrous material extending outwardly from a body of a device can "find" and follow the fluid flow, pulling the enlarged geometry or fibers into a restricted portion of a flow path, causing the enlarged geometry and additional strands to become tightly wedged into the flow path, thereby sealing off fluid communication.

The devices can be made of degradable or non-degradable materials. The degradable materials can be either self-degrading, or can require degrading treatments, such as, by exposing the materials to certain acids, certain base compositions, certain chemicals, certain types of radiation (e.g., electromagnetic or "nuclear"), or elevated temperature. The exposure can be performed at a desired time using a form of well intervention, such as, by spotting or circulating a fluid in the well so that the material is exposed to the fluid.

In some examples, the material can be an acid degradable material (e.g., nylon, etc.), a mix of acid degradable materials (for example, nylon fibers mixed with particulate such as calcium carbonate), self-degrading material (e.g., polylactic acid (PLA), poly-glycolic acid (PGA), etc.), material that degrades by galvanic action (such as, magnesium alloys, aluminum alloys, etc.), a combination of different self-degrading materials, or a combination of self-degrading and non-self-degrading materials.

Multiple materials can be pumped together or separately. For example, nylon and calcium carbonate could be pumped as a mixture, or the nylon could be pumped first to initiate a seal, followed by calcium carbonate to enhance the seal.

In certain examples described below, the device can be made of knotted fibrous materials. Multiple knots can be used with any number of loose ends. The ends can be frayed or un-frayed. The fibrous material can be rope, fabric, metal wool, cloth or another woven or braided structure.

The device can be used to block open sleeve valves, perforations or any leak paths in a well (such as, leaking connections in casing, corrosion holes, etc.). Any opening or passageway through which fluid flows can be blocked with a suitably configured device. For example, an intentionally or inadvertently opened rupture disk, or another opening in a well tool, could be plugged using the device.

In one example method described below, a well with an existing perforated zone can be re-completed. Devices (either degradable or non-degradable) are conveyed by flow to plug all existing perforations.

The well can then be re-completed using any desired completion technique. If the devices are degradable, a degrading treatment can then be placed in the well to open up the plugged perforations (if desired).

In another example method described below, multiple formation zones can be perforated and fractured (or otherwise stimulated, such as, by acidizing) in a single trip of the bottom hole assembly 22 into the well. In the method, one zone is perforated, the zone is stimulated, and then the perforated zone is plugged using one or more devices.

These steps are repeated for each additional zone, except that a last zone may not be plugged. All of the plugged zones are eventually unplugged by waiting a certain period of time (if the devices are self-degrading), by applying an appropriate degrading treatment, or by mechanically removing the devices.

Referring specifically now to FIGS. 2A-D, steps in an example of a method in which the bottom hole assembly 22 of FIG. 1 can be used in re-completing a well are representatively illustrated. In this method (see FIG. 2A), the well has existing perforations 38 that provide for fluid communication between an earth formation zone 40 and an interior of the casing 16. However, it is desired to re-complete the zone 40, in order to enhance the fluid communication.

Figure 2A:
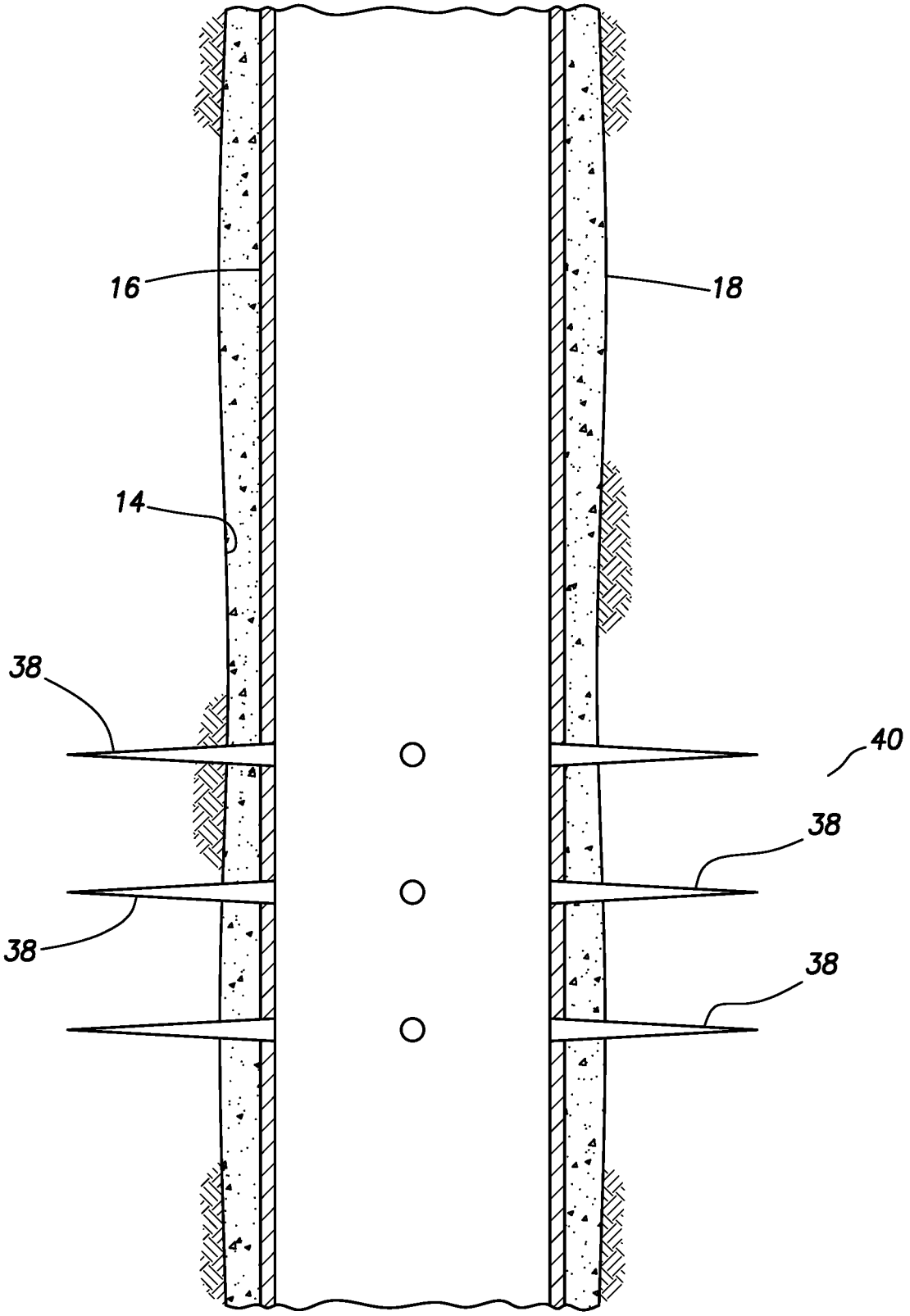
FIGS. 2A-D are enlarged scale representative partially cross-sectional views of steps in an example of a re-completion method that may be practiced with the system of FIG. 1.
Figure 2B:
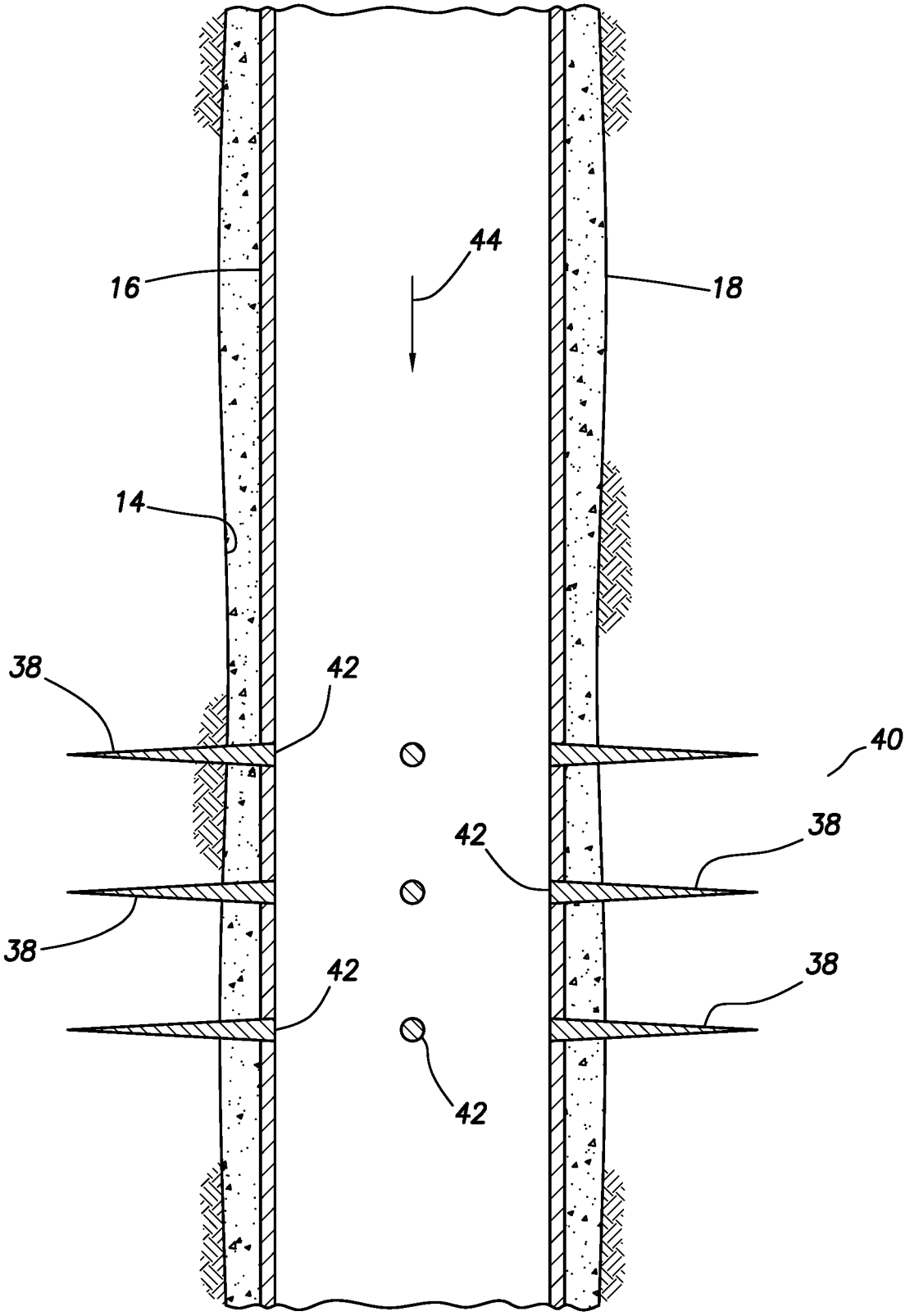

Referring additionally now to FIG. 2B, the perforations 38 are plugged, thereby preventing flow through the perforations into the zone 40. Plugs 42 in the perforations can be flow conveyed plugging devices, as described more fully below. In that case, the plugs 42 can be conveyed through the casing 16 and into engagement with the perforations 38 by fluid flow 44.

Figure 2C:
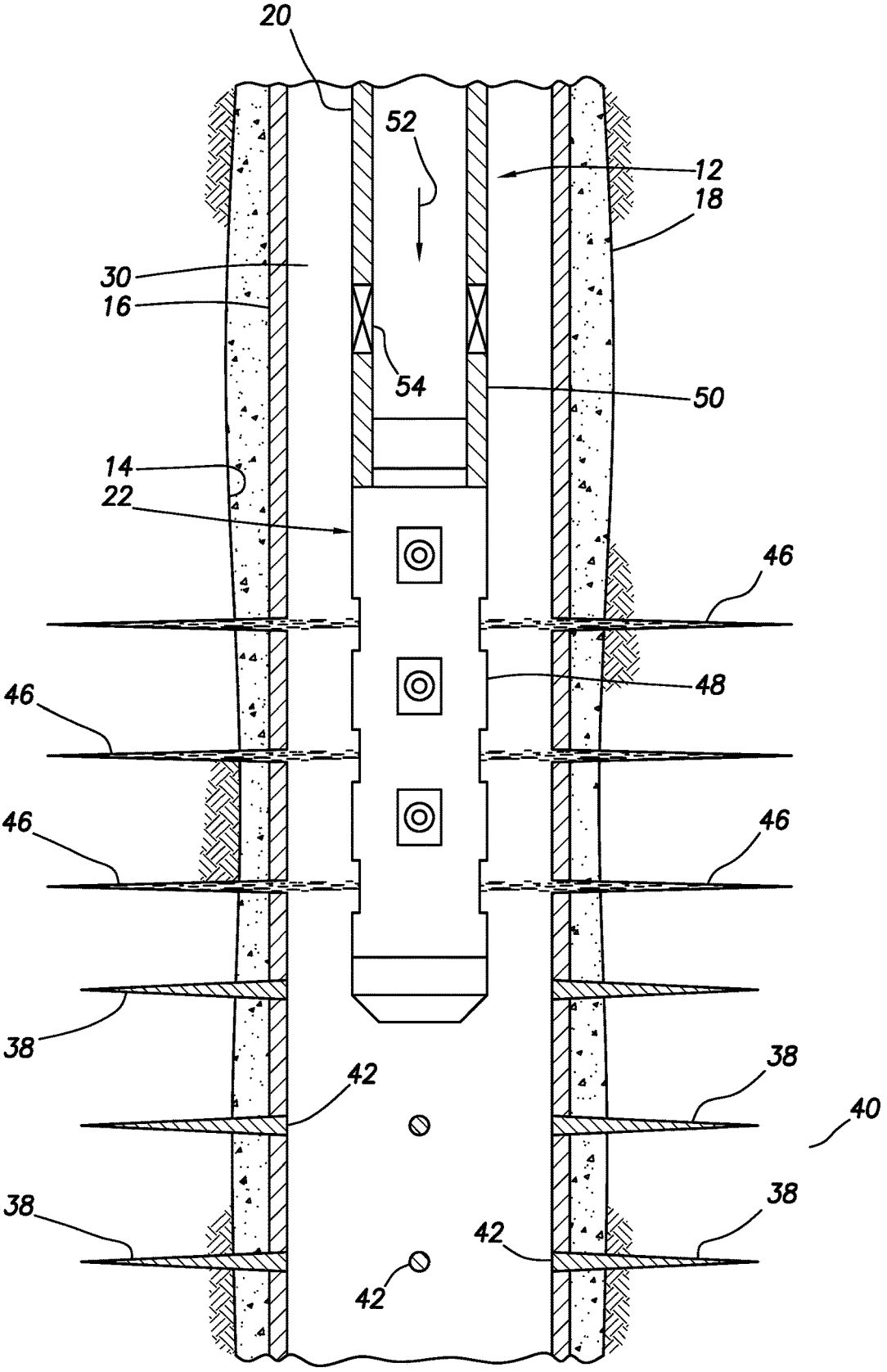

Referring additionally now to FIG. 2C, new perforations 46 are formed through the casing 16 and cement 18 by use of an abrasive jet perforator 48. In this example, the bottom hole assembly 22 includes the perforator 48 and a circulating valve assembly 50. Although the new perforations 46 are depicted as being formed above the existing perforations 38, the new perforations could be formed in any location in keeping with the principles of this disclosure.

Note that other means of providing perforations 46 may be used in other examples. Explosive perforators, drills, etc., may be used if desired. The scope of this disclosure is not limited to any particular perforating means, or to use with perforating at all.

The circulating valve assembly 50 controls flow between the coiled tubing 20 and the perforator 48, and controls flow between the annulus 30 and an interior of the tubular string 12. Instead of conveying the plugs 42 into the well via flow 44 through the interior of the casing 16 (see FIG. 2B), in other examples the plugs could be deployed into the tubular string 12 and conveyed by fluid flow 52 through the tubular string prior to the perforating operation. In that case, a valve 54 of the circulating valve assembly 50 could be opened to allow the plugs 42 to exit the tubular string 12 and flow into the interior of the casing 16 external to the tubular string.

Figure 2D:
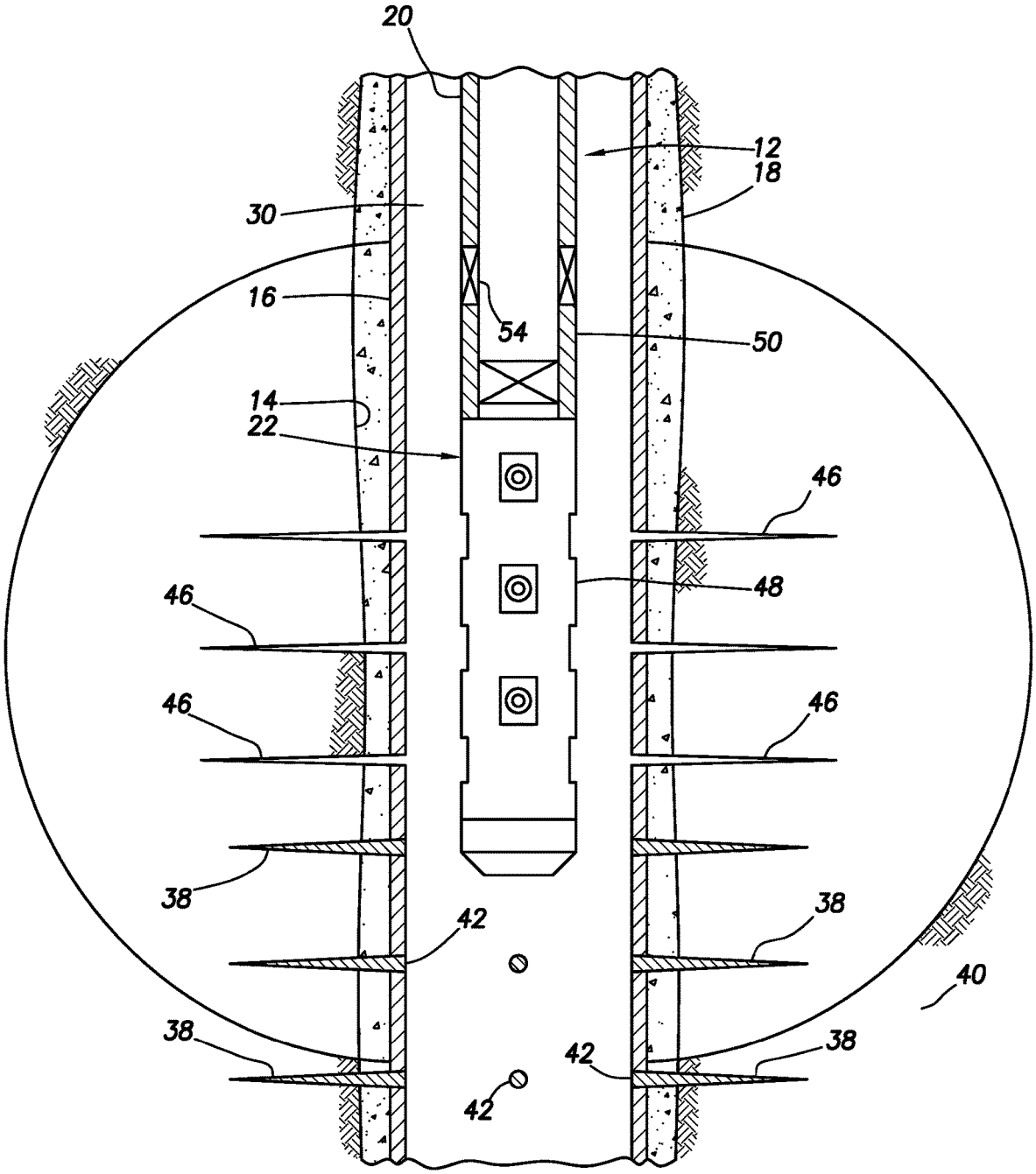

Referring additionally now to FIG. 2D, the zone 40 has been fractured by applying increased pressure to the zone after the perforating operation. Enhanced fluid communication is now permitted between the zone 40 and the interior of the casing 16.

Note that fracturing is not necessary in keeping with the principles of this disclosure. A zone could be stimulated (for example, by acidizing) with or without fracturing. Thus, although fracturing is described for certain examples, it should be understood that other types of stimulation treatments, in addition to or instead of fracturing, could be performed.

In the FIG. 2D example, the plugs 42 prevent the pressure applied to fracture the zone 40 via the perforations 46 from leaking into the zone via the perforations 38. The plugs 42 may remain in the perforations 38 and continue to prevent flow through the perforations, or the plugs may degrade, if desired, so that flow is eventually permitted through the perforations.

In other examples, fractures may be formed via the existing perforations 38, and no new perforations may be formed. In one technique, pressure may be applied in the casing 16 (e.g., using the pump 34), thereby initially fracturing the zone 40 via some of the perforations 38 that receive most of the fluid flow 44. After the initial fracturing of the zone 40, and while the fluid is flowed through the casing 16, plugs 42 can be released into the casing, so that the plugs seal off those perforations 38 that are receiving most of the fluid flow.

In this way, the fluid 44 will be diverted to other perforations 38, so that the zone 40 will also be fractured via those other perforations 38. The plugs 42 can be released into the casing 16 continuously or periodically as the fracturing operation progresses, so that the plugs gradually seal off all, or most, of the perforations 38 as the zone 40 is fractured via the perforations. That is, at each point in the fracturing operation, the plugs 42 will seal off those perforations 38 through which most of the fluid flow 44 would otherwise pass, which are the perforations via which the zone 40 has been fractured.

Referring additionally now to FIGS. 3A-D, steps in another example of a method in which the bottom hole assembly 22 of FIG. 1 can be used in completing multiple zones 40*a-c* of a well are representatively illustrated. The multiple zones 40*a-c* are each perforated and fractured during a single trip of the tubular string 12 into the well.

Figure 3A:
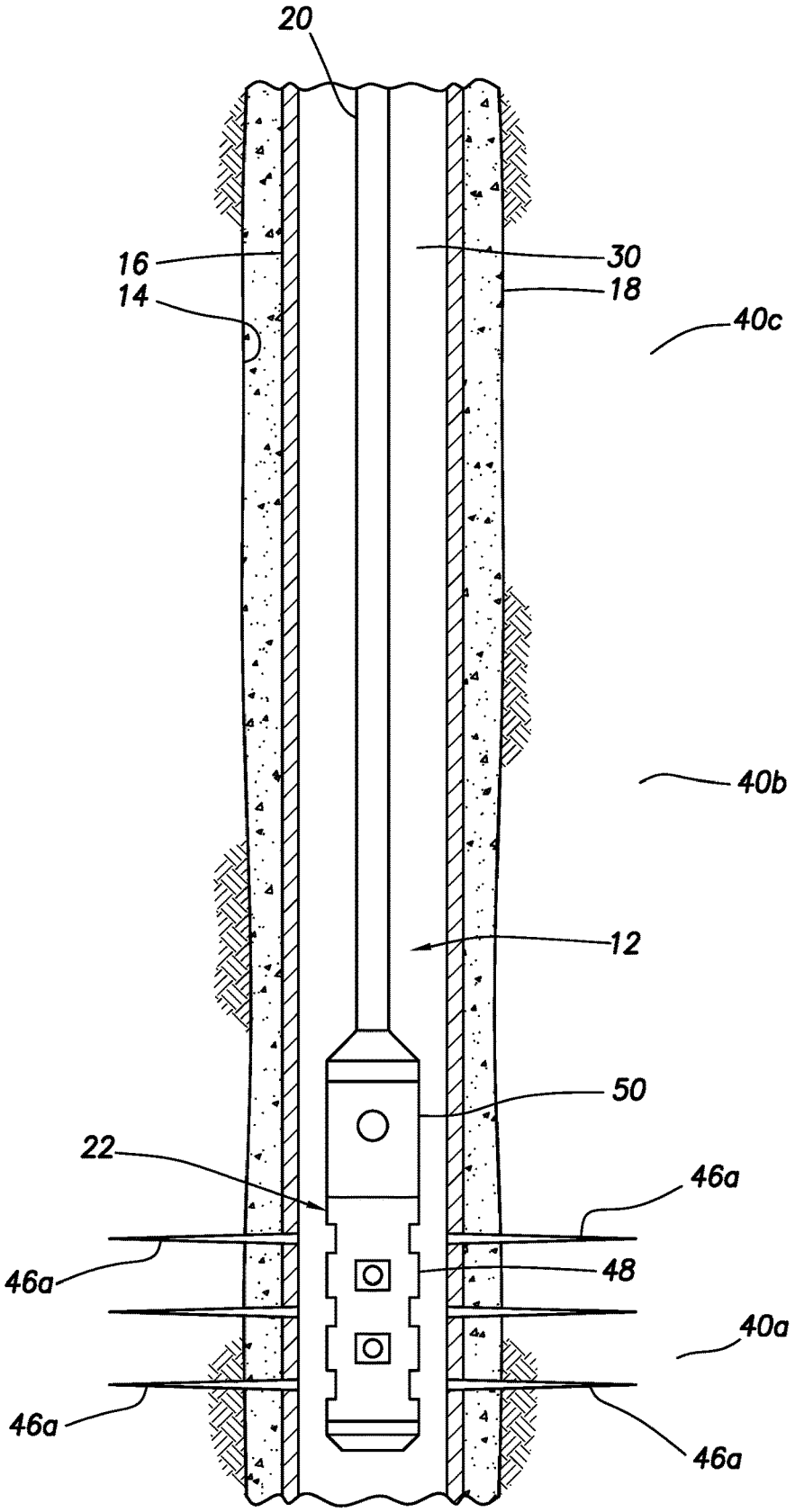
FIGS. 3A-D are representative partially cross-sectional views of steps in another example of a method that may be practiced with the system of FIG. 1.

In FIG. 3A, the tubular string 12 has been deployed into the casing 16, and has been positioned so that the perforator 48 is at the first zone 40*a* to be completed. The perforator 48 is then used to form perforations 46*a* through the casing 16 and cement 18, and into the zone 40*a*.

Figure 3B:
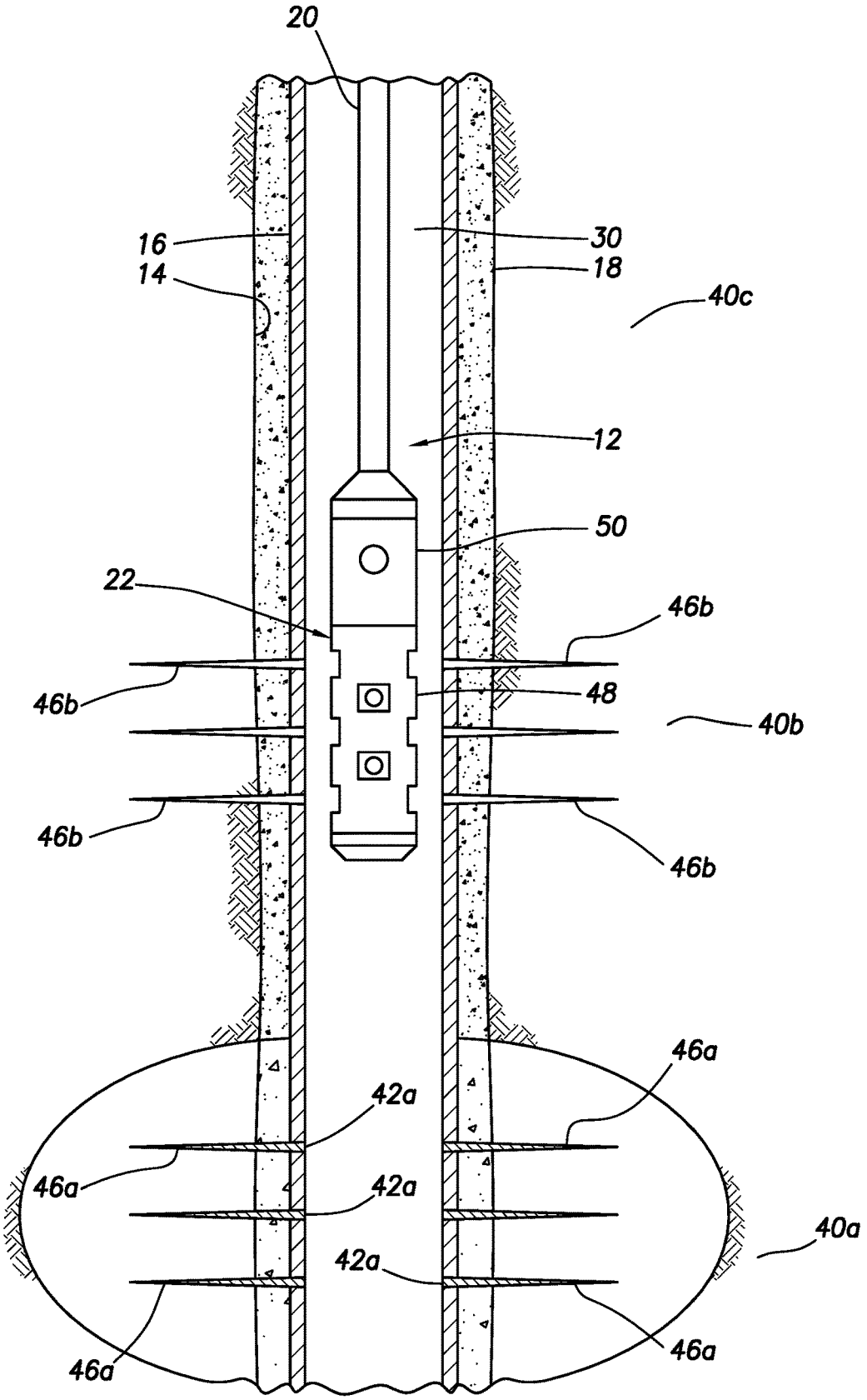

In FIG. 3B, the zone 40*a* has been fractured by applying increased pressure to the zone via the perforations 46*a*. The fracturing pressure may be applied, for example, via the annulus 30 from the surface (e.g., using the pump 34 of FIG. 1), or via the tubular string 12 (e.g., using the pump 36 of FIG. 1). The scope of this disclosure is not limited to any particular fracturing means or technique, or to the use of fracturing at all.

After fracturing of the zone 40*a*, the perforations 46*a* are plugged by deploying plugs 42*a* into the well and conveying them by fluid flow into sealing engagement with the perforations. The plugs 42*a* may be conveyed by flow 44 through the casing 16 (e.g., as in FIG. 2B), or by flow 52 through the tubular string 12 (e.g., as in FIG. 2C).

The tubular string 12 is repositioned in the casing 16, so that the perforator 48 is now located at the next zone 40*b* to be completed. The perforator 48 is then used to form perforations 46*b* through the casing 16 and cement 18, and into the zone 40*b*. The tubular string 12 may be repositioned before or after the plugs 42*a* are deployed into the well.

Figure 3C:
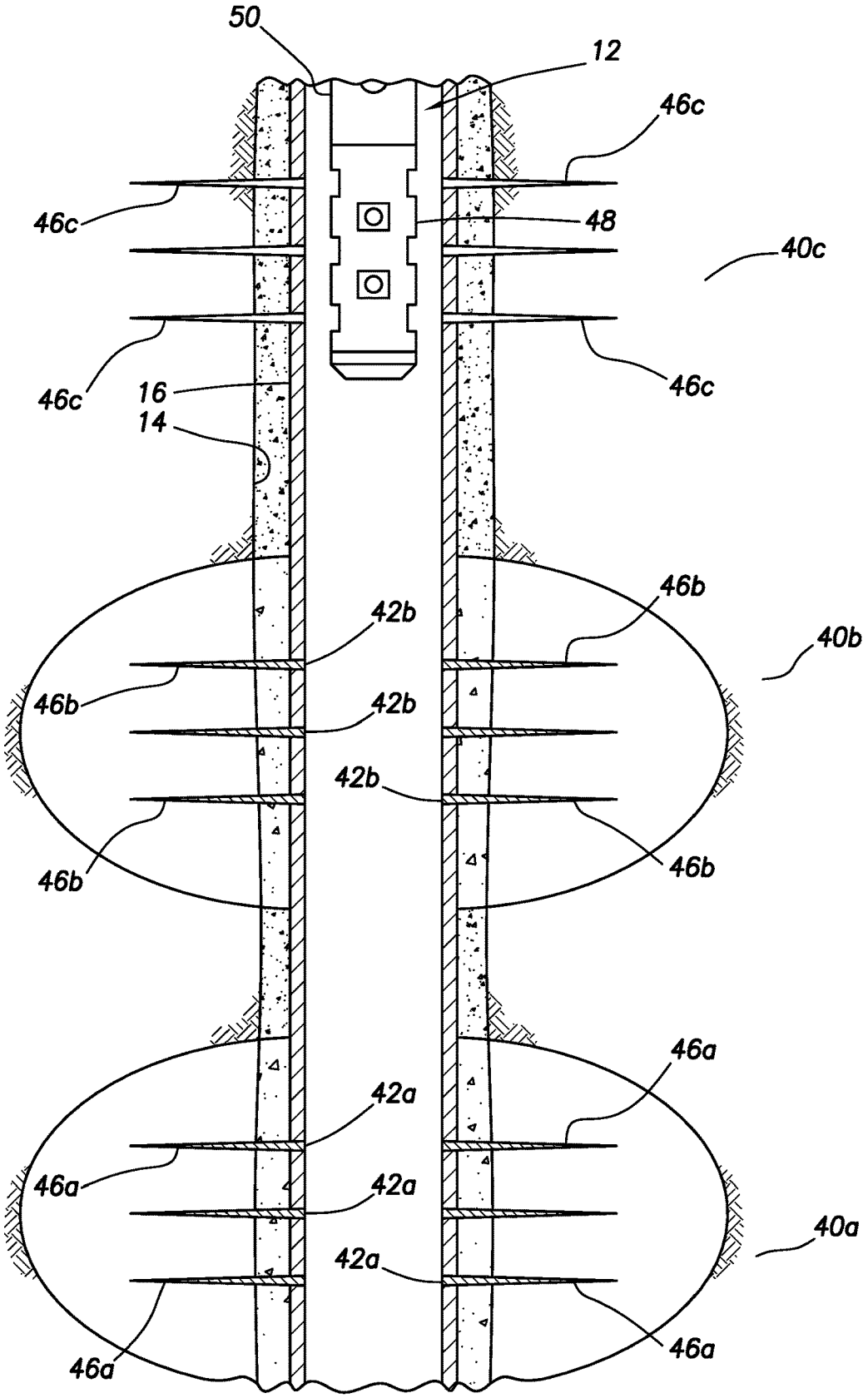

In FIG. 3C, the zone 40*b* has been fractured by applying increased pressure to the zone via the perforations 46*b*. The fracturing pressure may be applied, for example, via the annulus 30 from the surface (e.g., using the pump 34 of FIG. 1), or via the tubular string 12 (e.g., using the pump 36 of FIG. 1).

After fracturing of the zone 40*b*, the perforations 46*b* are plugged by deploying plugs 42*b* into the well and conveying them by fluid flow into sealing engagement with the perforations. The plugs 42*b* may be conveyed by flow 44 through the casing 16, or by flow 52 through the tubular string 12.

The tubular string 12 is repositioned in the casing 16, so that the perforator 48 is now located at the next zone 40*c* to be completed. The perforator 48 is then used to form perforations 46*c* through the casing 16 and cement 18, and into the zone 40*c*. The tubular string 12 may be repositioned before or after the plugs 42*b* are deployed into the well.

Figure 3D:
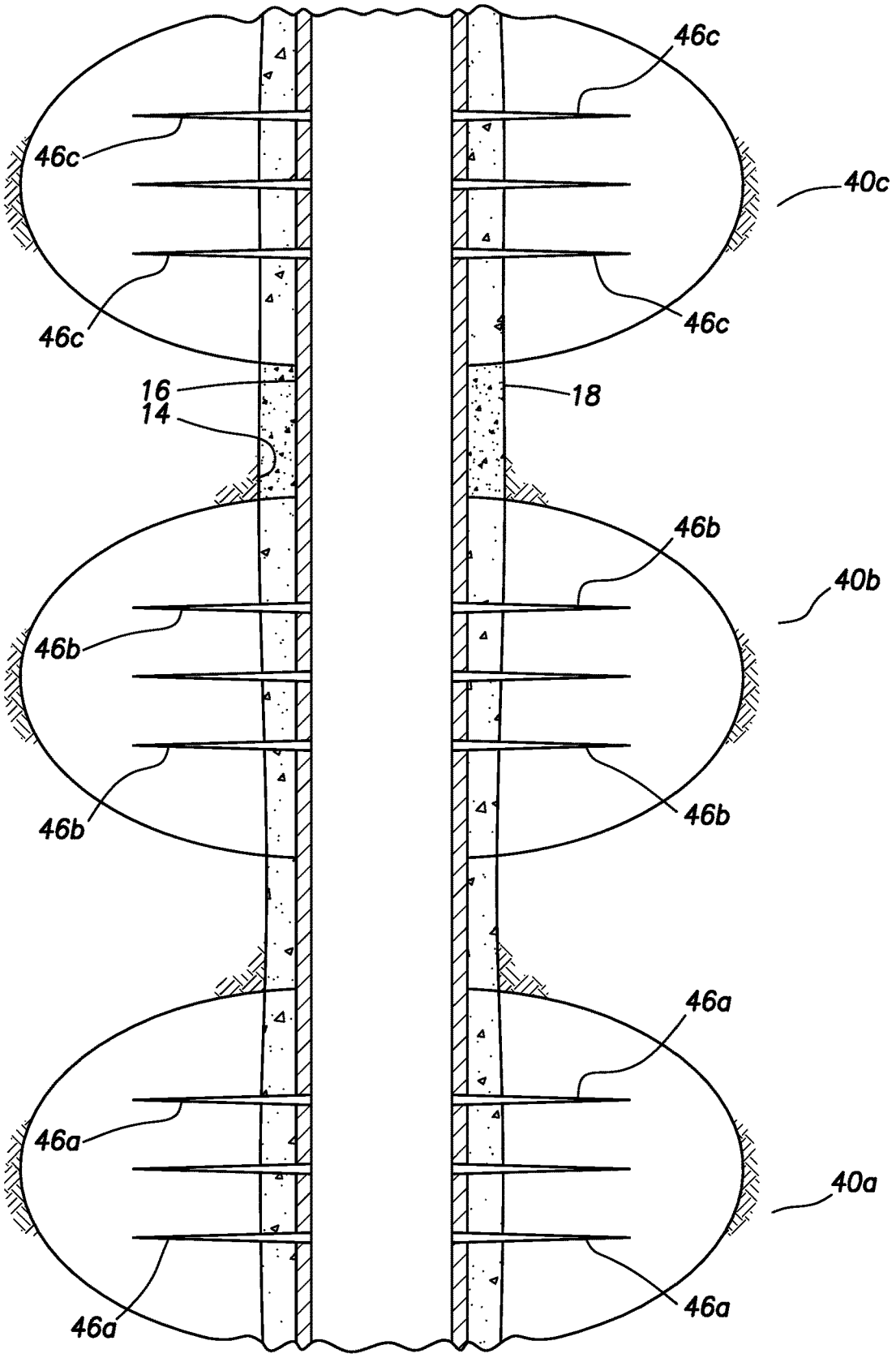

In FIG. 3D, the zone 40*c* has been fractured by applying increased pressure to the zone via the perforations 46*c*. The fracturing pressure may be applied, for example, via the annulus 30 from the surface (e.g., using the pump 34 of FIG. 1), or via the tubular string 12 (e.g., using the pump 36 of FIG. 1).

The plugs 42*a,b* are then degraded and no longer prevent flow through the perforations 46*a,b*. Thus, as depicted in FIG. 3D, flow is permitted between the interior of the casing 16 and each of the zones 40*a-c*.

The plugs 42*a,b* may be degraded in any manner. The plugs 42*a,b* may degrade in response to application of a degrading treatment, in response to passage of a certain period of time, or in response to exposure to elevated downhole temperature. The degrading treatment could include exposing the plugs 42*a,b* to a particular type of radiation, such as electromagnetic radiation (e.g., light having a certain wavelength or range of wavelengths, gamma rays, etc.) or "nuclear" particles (e.g., gamma, beta, alpha or neutron).

The plugs 42*a,b* may degrade by galvanic action or by dissolving. The plugs 42*a,b* may degrade in response to exposure to a particular fluid, either naturally occurring in the well (such as water or hydrocarbon fluid), or introduced therein (such as a fluid having a particular pH).

Note that any number of zones may be completed in any order in keeping with the principles of this disclosure. The zones 40*a-c* may be sections of a single earth formation, or they may be sections of separate formations. Although the perforations 46*c* are not described above as being plugged in the method, the perforations 46*c* could be plugged after the zone 40*c* is fractured or otherwise stimulated (e.g., to verify that the plugs are indeed preventing flow from the casing 16 to the zones 40*a-c*).

In other examples, the plugs 42 may not be degraded. The plugs 42 could instead be mechanically removed, for example, by milling or otherwise cutting the plugs 42 away from the perforations. In any of the method examples described above, after the fracturing operation(s) are completed, the plugs 42 can be milled off or otherwise removed from the perforations 38, 46, 46*a,b* without dissolving, melting, dispersing or otherwise degrading a material of the plugs.

In some examples, the plugs 42 can be mechanically removed, without necessarily cutting the plugs. A tool with appropriate gripping structures (such as a mill or another cutting or grabbing device) could grab the plugs 42 and pull them from the perforations.

Figure 4A:
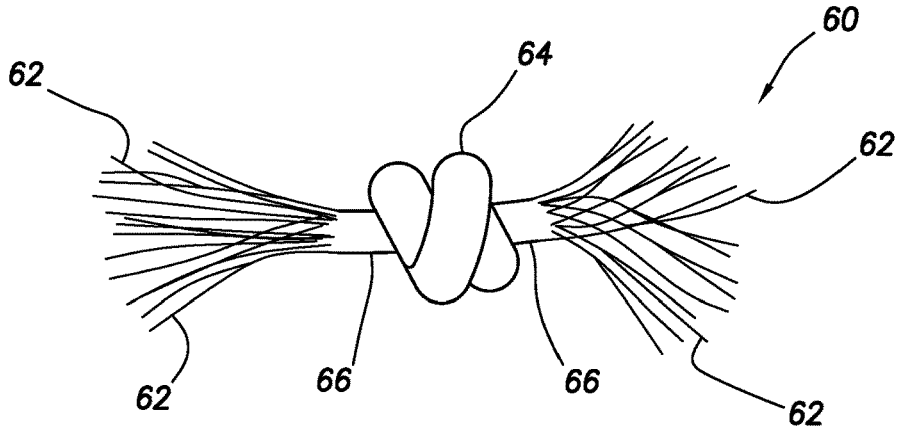
FIGS. 4A & B are enlarged scale representative elevational views of examples of a flow conveyed plugging device that may be used in the system and methods of FIGS. 1-3D, and which can embody the principles of this disclosure.

Referring additionally now to FIG. 4A, an example of a flow conveyed plugging device 60 that can incorporate the principles of this disclosure is representatively illustrated. The device 60 may be used for any of the plugs 42, 42*a,b* in the method examples described above, or the device may be used in other methods.

The device 60 example of FIG. 4A includes multiple fibers 62 extending outwardly from an enlarged central body 64. As depicted in FIG. 4A, each of the fibers 62 has a lateral dimension (e.g., a thickness or diameter) that is substantially smaller than a size (e.g., a thickness or diameter) of the body 64.

The body 64 can be dimensioned so that it will effectively engage and seal off a particular opening in a well. For example, if it is desired for the device 60 to seal off a perforation in a well, the body 64 can be formed so that it is somewhat larger than a diameter of the perforation. If it is desired for multiple devices 60 to seal off multiple openings having a variety of dimensions (such as holes caused by corrosion of the casing 16), then the bodies 64 of the devices can be formed with a corresponding variety of sizes.

In the FIG. 4A example, the fibers 62 are joined together (e.g., by braiding, weaving, cabling, etc.) to form lines 66 that extend outwardly from the body 64. In this example, there are two such lines 66, but any number of lines (including one) may be used in other examples.

The lines 66 may be in the form of one or more ropes, in which case the fibers 62 could comprise frayed (e.g., splayed outward) ends of the rope(s). In addition, the body 64 could be formed by one or more knots in the rope(s). In some examples, the body 64 can comprise a fabric or cloth, the body could be formed by one or more knots in the fabric or cloth, and the fibers 62 could extend from the fabric or cloth.

In other examples, the device 60 could comprise a single sheet of material, or multiple strips of sheet material. The device 60 could comprise one or more films. The body 64 and lines 66 may not be made of the same material, and the body and/or lines may not be made of a fibrous material.

In the FIG. 4A example, the body 64 is formed by a double overhand knot in a rope, and ends of the rope are frayed, so that the fibers 62 are splayed outward. In this manner, the fibers 62 will cause significant fluid drag when the device 60 is deployed into a flow stream, so that the device will be effectively "carried" by, and "follow," the flow.

However, it should be clearly understood that other types of bodies and other types of fibers may be used in other examples. The body 64 could have other shapes, the body could be hollow or solid, and the body could be made up of one or multiple materials. The fibers 62 are not necessarily joined by lines 66, and the fibers are not necessarily formed by fraying ends of ropes or other lines. The body 64 is not necessarily centrally located in the device 60 (for example, the body could be at one end of the lines 66). Thus, the scope of this disclosure is not limited to the construction, configuration or other details of the device 60 as described herein or depicted in the drawings.

Figure 4B:
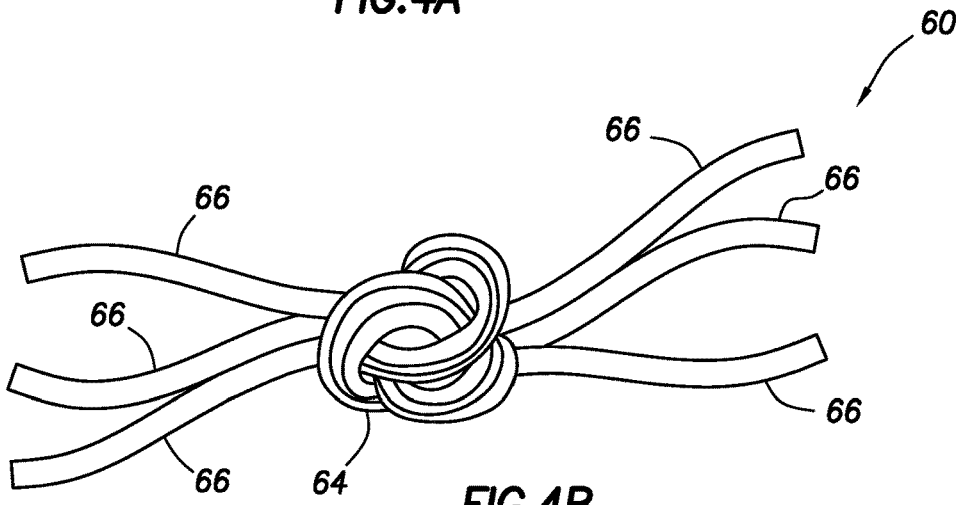

Referring additionally now to FIG. 4B, another example of the device 60 is representatively illustrated. In this example, the device 60 is formed using multiple braided lines 66 of the type known as "mason twine." The multiple lines 66 are knotted (such as, with a double or triple overhand knot or other type of knot) to form the body 64. Ends of the lines 66 are not necessarily frayed in these examples, although the lines do comprise fibers (such as the fibers 62 described above). In other examples, the lines 66 could comprise tubes, films, fabrics, mesh or other types of materials.

Figure 5:
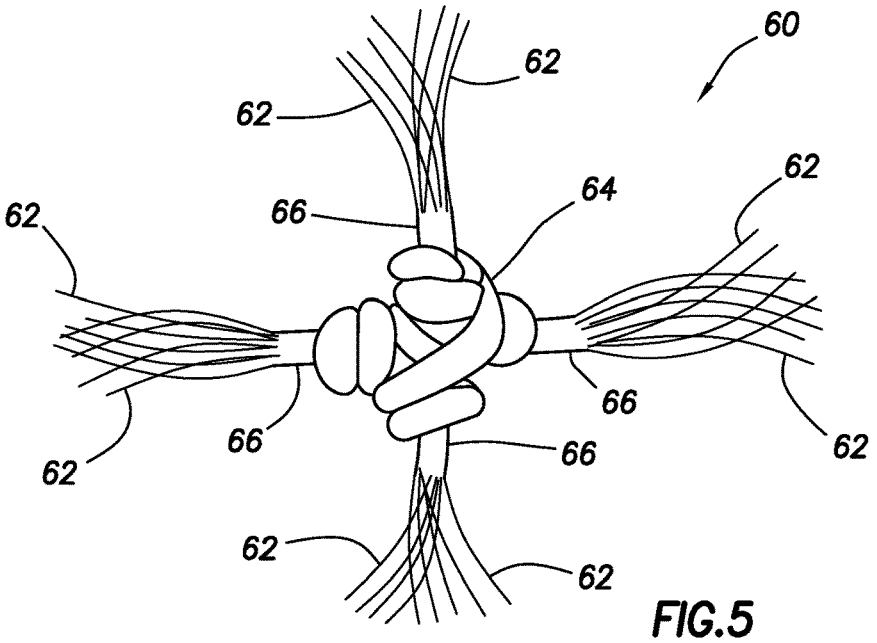
FIG. 5 is a representative elevational view of another example of the flow conveyed device.

Referring additionally now to FIG. 5, another example of the device 60 is representatively illustrated. In this example, four sets of the fibers 62 are joined by a corresponding number of lines 66 to the body 64. The body 64 is formed by one or more knots in the lines 66.

FIG. 5 demonstrates that a variety of different configurations are possible for the device 60. Accordingly, the principles of this disclosure can be incorporated into other configurations not specifically described herein or depicted in the drawings. Such other configurations may include fibers joined to bodies without use of lines, bodies formed by techniques other than knotting, etc.

Figure 6B:
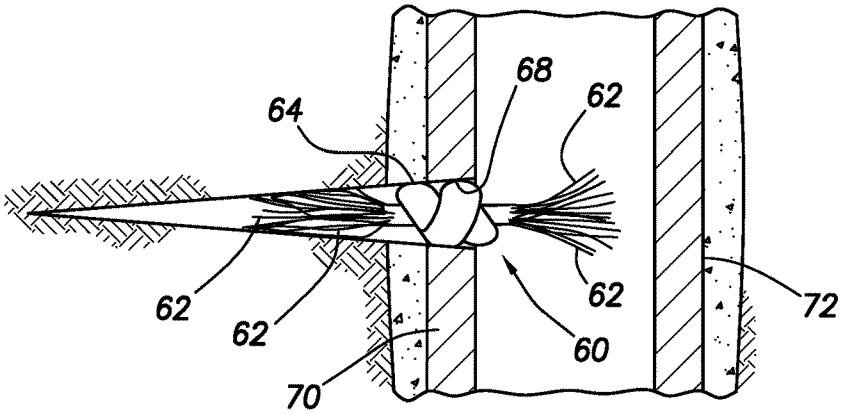
FIGS. 6A & B are representative partially cross-sectional views of the flow conveyed device in a well, the device being conveyed by flow in FIG. 6A, and engaging a casing opening in FIG. 6B.
Figure 6A:
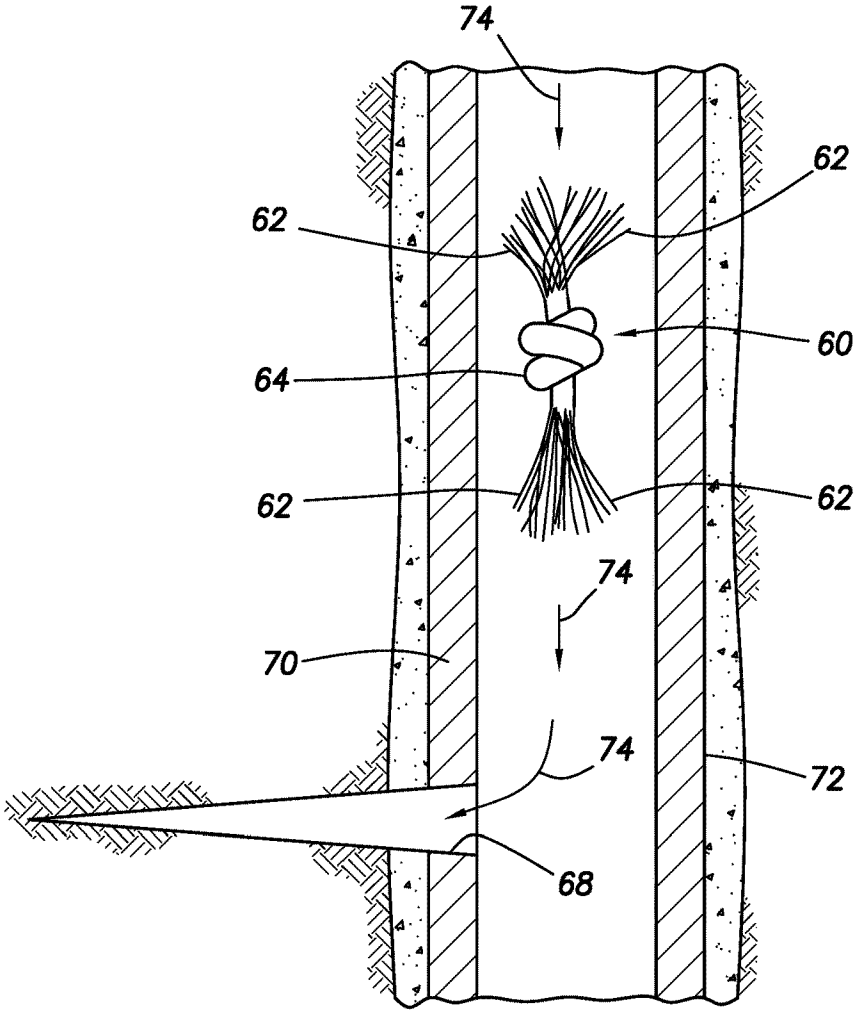

Referring additionally now to FIGS. 6A & B, an example of a use of the device 60 of FIGS. 4A-5 to seal off an opening 68 in a well is representatively illustrated. In this example, the opening 68 is a perforation formed through a sidewall 70 of a tubular string 72 (such as, a casing, liner, tubing, etc.). However, in other examples the opening 68 could be another type of opening, and may be formed in another type of structure.

The device 60 is deployed into the tubular string 72 and is conveyed through the tubular string by fluid flow 74. The fibers 62 of the device 60 enhance fluid drag on the device, so that the device is influenced to displace with the flow 74.

Since the flow 74 (or a portion thereof) exits the tubular string 72 via the opening 68, the device 60 will be influenced by the fluid drag to also exit the tubular string via the opening 68. As depicted in FIG. 6B, one set of the fibers 62 first enters the opening 68, and the body 64 follows. However, the body 64 is appropriately dimensioned, so that it does not pass through the opening 68, but instead is lodged or wedged into the opening. In some examples, the body 64 may be received only partially in the opening 68, and in other examples the body may be entirely received in the opening.

The body 64 may completely or only partially block the flow 74 through the opening 68. If the body 64 only partially blocks the flow 74, any remaining fibers 62 exposed to the flow in the tubular string 72 can be carried by that flow into any gaps between the body and the opening 68, so that a combination of the body and the fibers completely blocks flow through the opening.

In another example, the device 60 may partially block flow through the opening 68, and another material (such as, calcium carbonate, PLA or PGA particles) may be deployed and conveyed by the flow 74 into any gaps between the device and the opening, so that a combination of the device and the material completely blocks flow through the opening.

The device 60 may permanently prevent flow through the opening 68, or the device may degrade to eventually permit flow through the opening. If the device 60 degrades, it may be self-degrading, or it may be degraded in response to any of a variety of different stimuli. Any technique or means for degrading the device 60 (and any other material used in conjunction with the device to block flow through the opening 68) may be used in keeping with the scope of this disclosure.

In other examples, the device 60 may be mechanically removed from the opening 68. For example, if the body 64 only partially enters the opening 68, a mill or other cutting device may be used to cut the body from the opening.

Figure 7:
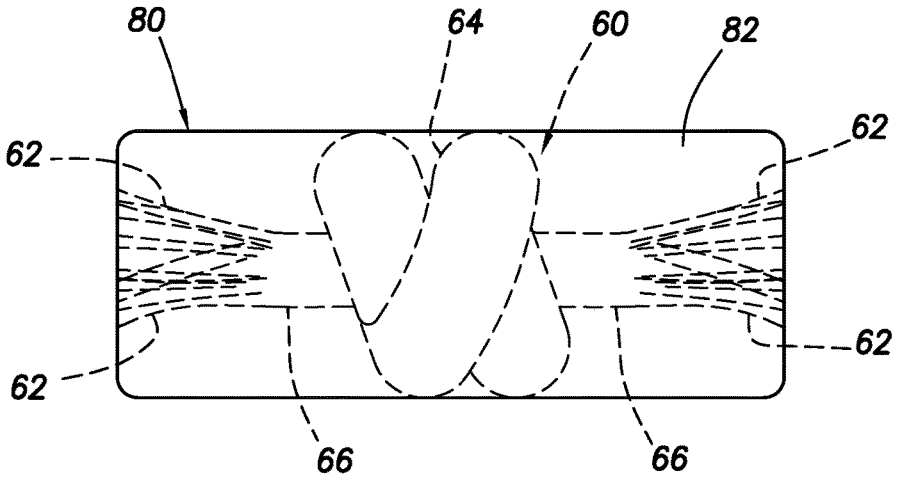
FIGS. 7-9 are representative elevational views of examples of the flow conveyed device with a retainer.
Figure 8:
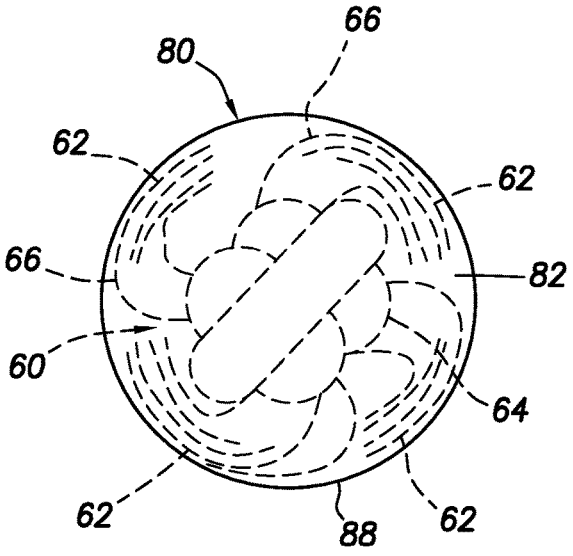
Figure 9:
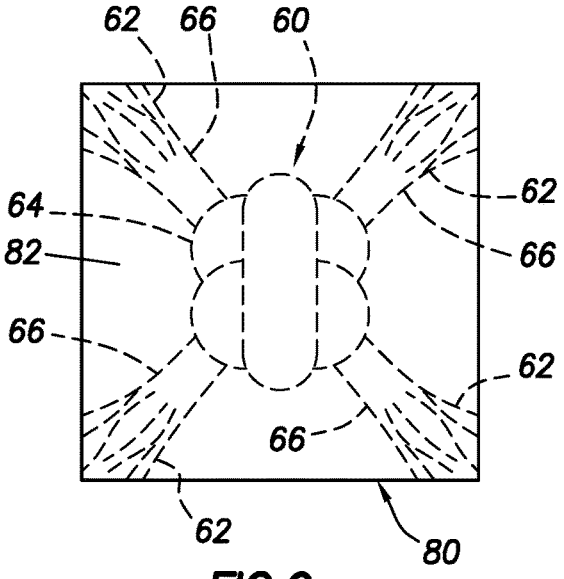

Referring additionally now to FIGS. 7-9, additional examples of the device 60 are representatively illustrated. In these examples, the device 60 is surrounded by, encapsulated in, molded in, or otherwise retained by, a retainer 80.

The retainer 80 aids in deployment of the device 60, particularly in situations where multiple devices are to be deployed simultaneously. In such situations, the retainer 80 for each device 60 prevents the fibers 62 and/or lines 66 from becoming entangled with the fibers and/or lines of other devices.

The retainer 80 could in some examples completely enclose the device 60. In other examples, the retainer 80 could be in the form of a binder that holds the fibers 62 and/or lines 66 together, so that they do not become entangled with those of other devices.

In some examples, the retainer 80 could have a cavity therein, with the device 60 (or only the fibers 62 and/or lines 66) being contained in the cavity. In other examples, the retainer 80 could be molded about the device 60 (or only the fibers 62 and/or lines 66).

During or after deployment of the device 60 into the well, the retainer 80 dissolves, melts, disperses or otherwise degrades, so that the device is capable of sealing off an opening 68 in the well, as described above. For example, the retainer 80 can be made of a material 82 that degrades in a wellbore environment.

The retainer material 82 may degrade after deployment into the well, but before arrival of the device 60 at the opening 68 to be plugged. In other examples, the retainer material 82 may degrade at or after arrival of the device 60 at the opening 68 to be plugged. If the device 60 also comprises a degradable material, then preferably the retainer material 82 degrades prior to the device material.

The material 82 could, in some examples, melt at elevated wellbore temperatures. The material 82 could be chosen to have a melting point that is between a temperature at the earth's surface and a temperature at the opening 68, so that the material melts during transport from the surface to the downhole location of the opening.

The material 82 could, in some examples, dissolve when exposed to wellbore fluid. The material 82 could be chosen so that the material begins dissolving as soon as it is deployed into the wellbore 14 and contacts a certain fluid (such as, water, brine, hydrocarbon fluid, etc.) therein. In other examples, the fluid that initiates dissolving of the material 82 could have a certain pH range that causes the material to dissolve.

Note that it is not necessary for the material 82 to melt or dissolve in the well. Various other stimuli (such as, passage of time, elevated pressure, flow, turbulence, etc.) could cause the material 82 to disperse, degrade or otherwise cease to retain the device 60. The material 82 could degrade in response to any one, or a combination, of: passage of a predetermined period of time in the well, exposure to a predetermined temperature in the well, exposure to a predetermined fluid in the well, exposure to radiation in the well and exposure to a predetermined chemical composition in the well. Thus, the scope of this disclosure is not limited to any particular stimulus or technique for dispersing or degrading the material 82, or to any particular type of material.

In some examples, the material 82 can remain on the device 60, at least partially, when the device engages the opening 68. For example, the material 82 could continue to cover the body 64 (at least partially) when the body engages and seals off the opening 68. In such examples, the material 82 could advantageously comprise a relatively soft, viscous and/or resilient material, so that sealing between the device 60 and the opening 68 is enhanced.

Suitable relatively low melting point substances that may be used for the material 82 can include wax (e.g., paraffin wax, vegetable wax), ethylene-vinyl acetate copolymer (e.g., ELVAX™ available from DuPont), atactic polypropylene, and eutectic alloys. Suitable relatively soft substances that may be used for the material 82 can include a soft silicone composition or a viscous liquid or gel.

Suitable dissolvable materials can include PLA, PGA, anhydrous boron compounds (such as anhydrous boric oxide and anhydrous sodium borate), polyvinyl alcohol, polyethylene oxide, salts and carbonates. The dissolution rate of a water-soluble polymer (e.g., polyvinyl alcohol, polyethylene oxide) can be increased by incorporating a water-soluble plasticizer (e.g., glycerin), or a rapidly-dissolving salt (e.g., sodium chloride, potassium chloride), or both a plasticizer and a salt.

In FIG. 7, the retainer 80 is in a cylindrical form. The device 60 is encapsulated in, or molded in, the retainer material 82. The fibers 62 and lines 66 are, thus, prevented from becoming entwined with the fibers and lines of any other devices 60.

In FIG. 8, the retainer 80 is in a spherical form. In addition, the device 60 is compacted, and its compacted shape is retained by the retainer material 82. A shape of the retainer 80 can be chosen as appropriate for a particular device 60 shape, in compacted or un-compacted form.

In FIG. 9, the retainer 80 is in a cubic form. Thus, any type of shape (polyhedron, spherical, cylindrical, etc.) may be used for the retainer 80, in keeping with the principles of this disclosure.

Figure 10:
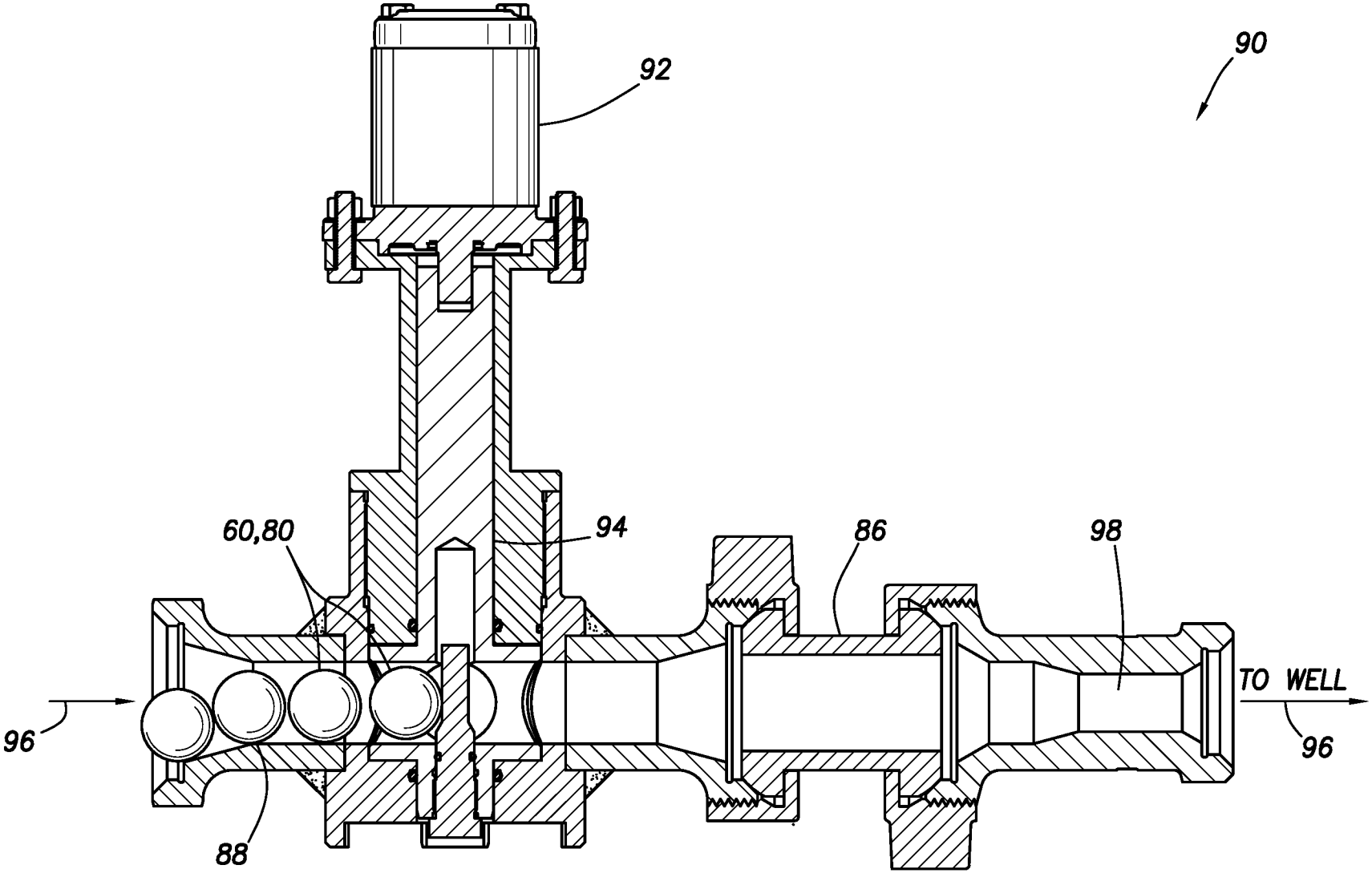
FIG. 10 is a representative cross-sectional view of an example of a deployment apparatus and method that can embody the principles of this disclosure.

Referring additionally now to FIG. 10, an example of a deployment apparatus 90 and an associated method are representatively illustrated. The apparatus 90 and method may be used with the system 10 and method described above, or they may be used with other systems and methods.

When used with the system 10, the apparatus 90 can be connected between the pump 34 and the casing valve 32 (see FIG. 1). Alternatively, the apparatus 90 can be "teed" into a pipe associated with the pump 34 and casing valve 32, or into a pipe associated with the pump 36 (for example, if the devices 60 are to be deployed via the tubular string 12). However configured, an output of the apparatus 90 is connected to the well, although the apparatus itself may be positioned a distance away from the well.

The apparatus 90 is used in this example to deploy the devices 60 into the well. The devices 60 may or may not be retained by the retainer 80 when they are deployed. However, in the FIG. 10 example, the devices 60 are depicted with the retainers 80 in the spherical shape of FIG. 8, for convenience of deployment. The retainer material 82 can be at least partially dispersed during the deployment, so that the devices 60 are more readily conveyed by the flow 74.

In certain situations, it can be advantageous to provide a certain spacing between the devices 60 during deployment, for example, in order to efficiently plug casing perforations. One reason for this is that the devices 60 will tend to first plug perforations that are receiving highest rates of flow.

In addition, if the devices 60 are deployed downhole too close together, some of them can become trapped between perforations, thereby wasting some of the devices. The excess "wasted" devices 60 might later interfere with other well operations.

To mitigate such problems, the devices 60 can be deployed with a selected spacing. The spacing may be, for example, on the order of the length of the perforation interval. The apparatus 90 is desirably capable of deploying the devices 60 with any selected spacing between the devices.

Each device 60 in this example has the retainer 80 in the form of a dissolvable coating material with a frangible coating 88 thereon, to impart a desired geometric shape (spherical in this example), and to allow for convenient deployment. The dissolvable retainer material 82 could be detrimental to the operation of the device 60 if it increases a drag coefficient of the device. A high coefficient of drag can cause the devices 60 to be swept to a lower end of the perforation interval, instead of sealing uppermost perforations.

The frangible coating 88 is used to prevent the dissolvable coating from dissolving during a queue time prior to deployment. Using the apparatus 90, the frangible coating 88 can be desirably broken, opened or otherwise damaged during the deployment process, so that the dissolvable coating is then exposed to fluids that can cause the coating to dissolve.

Examples of suitable frangible coatings include cementitious materials (e.g., plaster of Paris) and various waxes (e.g., paraffin wax, carnauba wax, vegetable wax, machinable wax). The frangible nature of a wax coating can be optimized for particular conditions by blending a less brittle wax (e.g., paraffin wax) with a more brittle wax (e.g., carnauba wax) in a certain ratio selected for the particular conditions.

As depicted in FIG. 10, the apparatus 90 includes a rotary actuator 92 (such as, a hydraulic or electric servo motor, with or without a rotary encoder). The actuator 92 rotates a sequential release structure 94 that receives each device 60 in turn from a queue of the devices, and then releases each device one at a time into a conduit 86 that is connected to the tubular string 72 (or the casing 16 or tubing 20 of FIG. 1).

Note that it is not necessary for the actuator 92 to be a rotary actuator, since other types of actuators (such as, a linear actuator) may be used in other examples. In addition, it is not necessary for only a single device 60 to be deployed at a time. In other examples, the release structure 94 could be configured to release multiple devices at a time. Thus, the scope of this disclosure is not limited to any particular details of the apparatus 90 or the associated method as described herein or depicted in the drawings.

In the FIG. 10 example, a rate of deployment of the devices 60 is determined by an actuation speed of the actuator 92. As a speed of rotation of the structure 94 increases, a rate of release of the devices 60 from the structure accordingly increases. Thus, the deployment rate can be conveniently adjusted by adjusting an operational speed of the actuator 92. This adjustment could be automatic, in response to well conditions, stimulation treatment parameters, flow rate variations, etc.

As depicted in FIG. 10, a liquid flow 96 enters the apparatus 90 from the left and exits on the right (for example, at about 1 barrel per minute). Note that the flow 96 is allowed to pass through the apparatus 90 at any position of the release structure 94 (the release structure is configured to permit flow through the structure at any of its positions).

When the release structure 94 rotates, one or more of the devices 60 received in the structure rotates with the structure. When a device 60 is on a downstream side of the release structure 94, the flow 96 though the apparatus 90 carries the device to the right (as depicted in FIG. 10) and into a restriction 98.

The restriction 98 in this example is smaller than the outer diameter of the device 60. The flow 96 causes the device 60 to be forced through the restriction 98, and the frangible coating 88 is thereby damaged, opened or fractured to allow the inner dissolvable material 82 of the retainer 80 to dissolve.

Other ways of opening, breaking or damaging a frangible coating may be used in keeping with the principles of this disclosure. For example, cutters or abrasive structures could contact an outside surface of a device 60 to penetrate, break, abrade or otherwise damage the frangible coating 88. Thus, this disclosure is not limited to any particular technique for damaging, breaking, penetrating or otherwise compromising a frangible coating.

Figure 11:
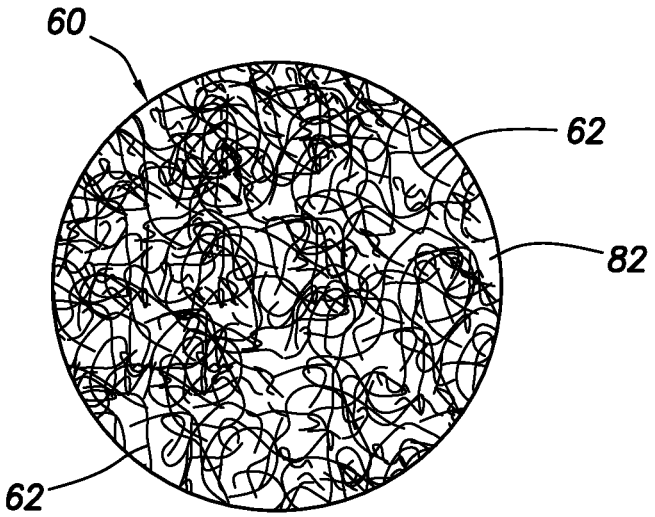
FIGS. 11 & 12 are representative cross-sectional views of additional examples of the flow conveyed device.
Figure 12:
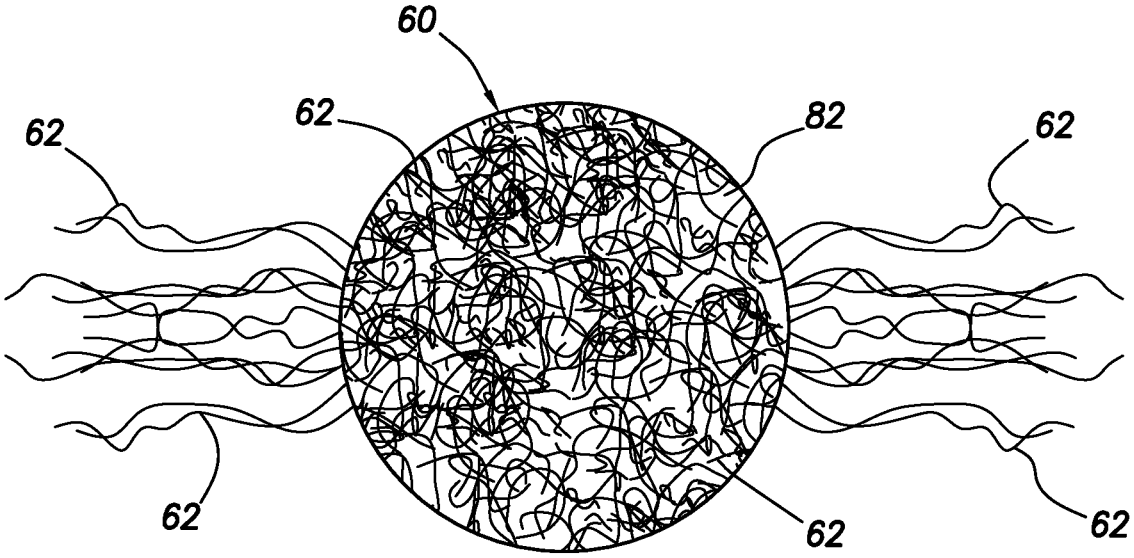

Referring additionally now to FIG. 11, a cross-sectional view of another example of the device 60 is representatively illustrated. The device 60 may be used in any of the systems and methods described herein, or may be used in other systems and methods.

In this example, the body of the device 60 is made up of filaments or fibers 62 formed in the shape of a ball or sphere. Of course, other shapes may be used, if desired.

The filaments or fibers 62 may make up all, or substantially all, of the device 60. The fibers 62 may be randomly oriented, or they may be arranged in various orientations as desired.

In the FIG. 11 example, the fibers 62 are retained by the dissolvable, degradable or dispersible material 82. In addition, a frangible coating may be provided on the device 60, for example, in order to delay dissolving of the material 82 until the device has been deployed into a well (as in the example of FIG. 10).

The device 60 of FIG. 11 can be used in a diversion fracturing operation (in which perforations receiving the most fluid are plugged to divert fluid flow to other perforations), in a re-completion operation (e.g., as in the FIGS. 2A-D example), or in a multiple zone perforate and fracture operation (e.g., as in the FIGS. 3A-D example).

One advantage of the FIG. 11 device 60 is that it is capable of sealing on irregularly shaped openings, perforations, leak paths or other passageways. The device 60 can also tend to "stick" or adhere to an opening, for example, due to engagement between the fibers 62 and structure surrounding (and in) the opening. In addition, there is an ability to selectively seal openings.

The fibers 62 could, in some examples, comprise wool fibers. The device 60 may be reinforced (e.g., using the material 82 or another material) or may be made entirely of fibrous material with a substantial portion of the fibers 62 randomly oriented.

The fibers 62 could, in some examples, comprise metal wool, or crumpled and/or compressed wire. Wool may be retained with wax or other material (such as the material 82) to form a ball, sphere, cylinder or other shape.

In the FIG. 11 example, the material 82 can comprise a wax (or eutectic metal or other material) that melts at a selected predetermined temperature. A wax device 60 may be reinforced with fibers 62, so that the fibers and the wax (material 82) act together to block a perforation or other passageway.

The selected melting point can be slightly less than a static wellbore temperature. The wellbore temperature during fracturing is typically depressed due to relatively low temperature fluids entering the wellbore. After fracturing, wellbore temperature will typically increase toward the static wellbore temperature, thereby melting the wax and releasing the reinforcement fibers 62.

Figure 13:
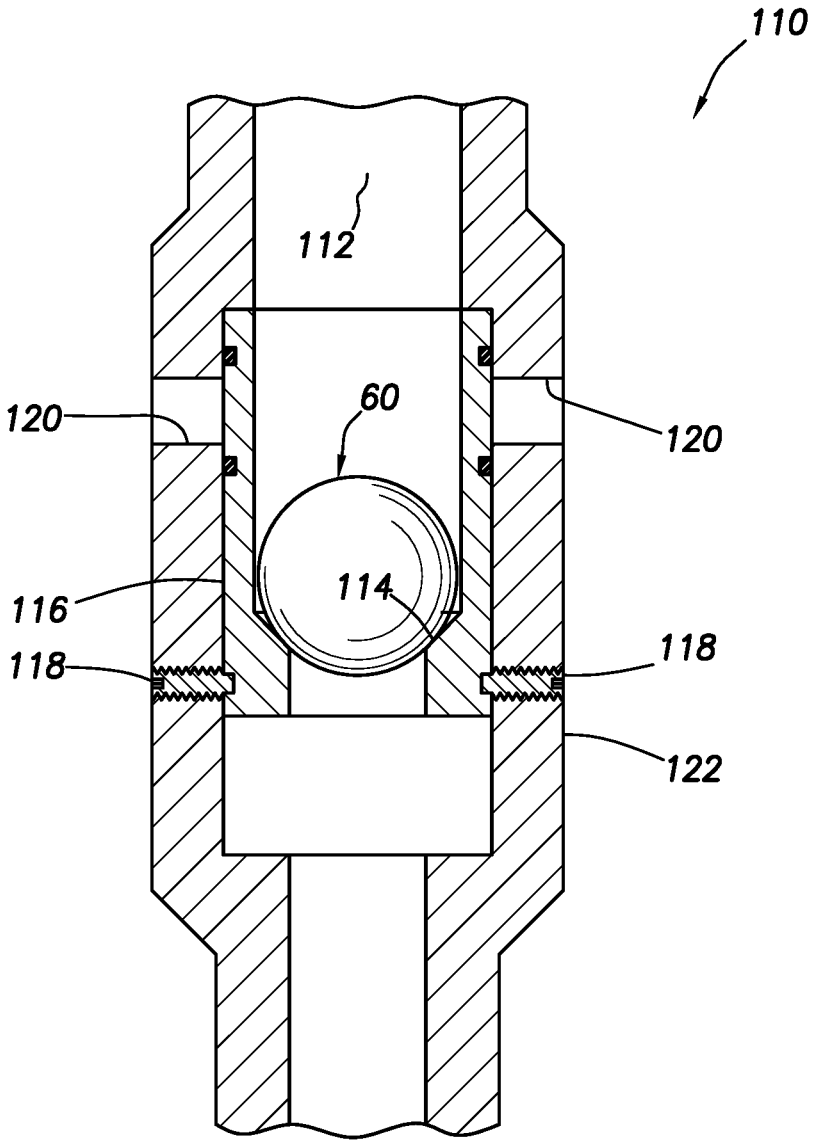
FIG. 13 is a representative cross-sectional view of a well tool that may be operated using the flow conveyed device.

This type of device 60 in the shape of a ball or other shapes may be used to operate downhole tools in a similar fashion. In FIG. 13, a well tool 110 is depicted with a passageway 112 extending longitudinally through the well tool. The well tool 110 could, for example, be connected in the casing 16 of FIG. 1, or it could be connected in another tubular string (such as a production tubing string, the tubular string 12, etc.).

The device 60 is depicted in FIG. 13 as being sealingly engaged with a seat 114 formed in a sliding sleeve 116 of the well tool 110. When the device 60 is so engaged in the well tool 110 (for example, after the well tool is deployed into a well and appropriately positioned), a pressure differential may be produced across the device and the sliding sleeve 116, in order to shear frangible members 118 and displace the sleeve downward (as viewed in FIG. 13), thereby allowing flow between the passageway 112 and an exterior of the well tool 110 via openings 120 formed through an outer housing 122.

The material 82 of the device 60 can then dissolve, disperse or otherwise degrade to thereby permit flow through the passageway 112. Of course, other types of well tools (such as, packer setting tools, frac plugs, testing tools, etc.) may be operated or actuated using the device 60 in keeping with the scope of this disclosure.

A drag coefficient of the device 60 in any of the examples described herein may be modified appropriately to produce a desired result. For example, in a diversion fracturing operation, it is typically desirable to block perforations at a certain location in a wellbore. The location is usually at the perforations taking the most fluid.

Natural fractures in an earth formation penetrated by the wellbore make it so that certain perforations receive a larger portion of fracturing fluids. For these situations and others, the device 60 shape, size, density and other characteristics can be selected, so that the device tends to be conveyed by flow to a certain corresponding section of the wellbore.

For example, devices 60 with a larger coefficient of drag (Cd) may tend to seat more toward a toe of a generally horizontal or lateral wellbore. Devices 60 with a smaller Cd may tend to seat more toward a heel of the wellbore. For example, if the wellbore 14 depicted in FIG. 2B is horizontal or highly deviated, the heel would be at an upper end of the illustrated wellbore, and the toe would be at the lower end of the illustrated wellbore (e.g., the direction of the fluid flow 44 is from the heel to the toe).

Smaller devices 60 with long fibers 62 floating freely (see the example of FIG. 12) may have a strong tendency to seat at or near the heel. A diameter of the device 60 and the free fiber 62 length can be appropriately selected, so that the device is more suited to stopping and sealingly engaging perforations anywhere along the length of the wellbore.

Acid treating operations can benefit from use of the device 60 examples described herein. Pumping friction causes hydraulic pressure at the heel to be considerably higher than at the toe. This means that the fluid volume pumped into a formation at the heel will be considerably higher than at the toe. Turbulent fluid flow increases this effect. Gelling additives might reduce an onset of turbulence and decrease the magnitude of the pressure drop along the length of the wellbore.

Higher initial pressure at the heel allows zones to be acidized and then plugged starting at the heel, and then progressively down along the wellbore. This mitigates waste of acid from attempting to acidize all of the zones at the same time.

The free fibers 62 of the FIGS. 4-6B & 12 examples greatly increase the ability of the device 60 to engage the first open perforation (or other leak path) it encounters. Thus, the devices 60 with low Cd and long fibers 62 can be used to plug from upper perforations to lower perforations, while turbulent acid with high frictional pressure drop is used so that the acid treats the unplugged perforations nearest the top of the wellbore with acid first.

In examples of the device 60 where a wax material (such as the material 82) is used, the fibers 62 (including the body 64, lines 66, knots, etc.) may be treated with a treatment fluid that repels wax (e.g., during a molding process). This may be useful for releasing the wax from the fibrous material after fracturing or otherwise compromising the retainer 80 and/or a frangible coating thereon.

Suitable release agents are water-wetting surfactants (e.g., alkyl ether sulfates, high hydrophilic-lipophilic balance (HLB) nonionic surfactants, betaines, alkyarylsulfonates, alkyldiphenyl ether sulfonates, alkyl sulfates). The release fluid may also comprise a binder to maintain the knot or body 64 in a shape suitable for molding. One example of a binder is a polyvinyl acetate emulsion.

Broken-up or fractured devices 60 can have lower Cd. Broken-up or fractured devices 60 can have smaller cross-sections and can pass through the annulus 30 between tubing 20 and casing 16 more readily.

The restriction 98 (see FIG. 10) may be connected in any line or pipe that the devices 60 are pumped through, in order to cause the devices to fracture as they pass through the restriction. This may be used to break up and separate devices 60 into wax and non-wax parts. The restriction 98 may also be used for rupturing a frangible coating covering a soluble wax material 82 to allow water or other well fluids to dissolve the wax.

Fibers 62 may extend outwardly from the device 60, whether or not the body 64 or other main structure of the device also comprises fibers. For example, a ball (or other shape) made of any material could have fibers 62 attached to and extending outwardly therefrom. Such a device 60 will be better able to find and cling to openings, holes, perforations or other leak paths near the heel of the wellbore, as compared to the ball (or other shape) without the fibers 62.

For any of the device 60 examples described herein, the fibers 62 may not dissolve, disperse or otherwise degrade in the well. In such situations, the devices 60 (or at least the fibers 62) may be removed from the well by swabbing, scraping, circulating, milling or other mechanical methods.

In situations where it is desired for the fibers 62 to dissolve, disperse or otherwise degrade in the well, nylon is a suitable acid soluble material for the fibers. Nylon 6 and nylon 66 are acid soluble and suitable for use in the device 60. At relatively low well temperatures, nylon 6 may be preferred over nylon 66, because nylon 6 dissolves faster or more readily.

Self-degrading fiber devices 60 can be prepared from poly-lactic acid (PLA), poly-glycolic acid (PGA), or a combination of PLA and PGA fibers 62. Such fibers 62 may be used in any of the device 60 examples described herein.

Suitable materials are described in U.S. Publication Nos. 2012/0067581, 2014/0374106 and 2015/0284879.

Fibers 62 can be continuous monofilament or multifilament, or chopped fiber. Chopped fibers 62 can be carded and twisted into yarn that can be used to prepare fibrous flow conveyed devices 60.

The PLA and/or PGA fibers 62 may be coated with a protective material, such as calcium stearate, to slow its reaction with water and thereby delay degradation of the device 60. Different combinations of PLA and PGA materials may be used to achieve corresponding different degradation times or other characteristics.

PLA resin can be spun into fiber of 1-15 denier, for example. Smaller diameter fibers 62 will degrade faster. Fiber denier of less than 5 may be most desirable. PLA resin is commercially available with a range of melting points (e.g., 60 to 185° C.). Fibers 62 spun from lower melting point PLA resin can degrade faster.

PLA bi-component fiber has a core of high-melting point PLA resin and a sheath of low-melting point PLA resin (e.g., 60° C. melting point sheath on a 130° C. melting point core). The low-melting point resin can hydrolyze more rapidly and generate acid that will accelerate degradation of the high-melting point core. This may enable the preparation of a plugging device 60 that will have higher strength in a wellbore environment, yet still degrade in a reasonable time. In various examples, a melting point of the resin can decrease in a radially outward direction in the fiber.

Figure 14:
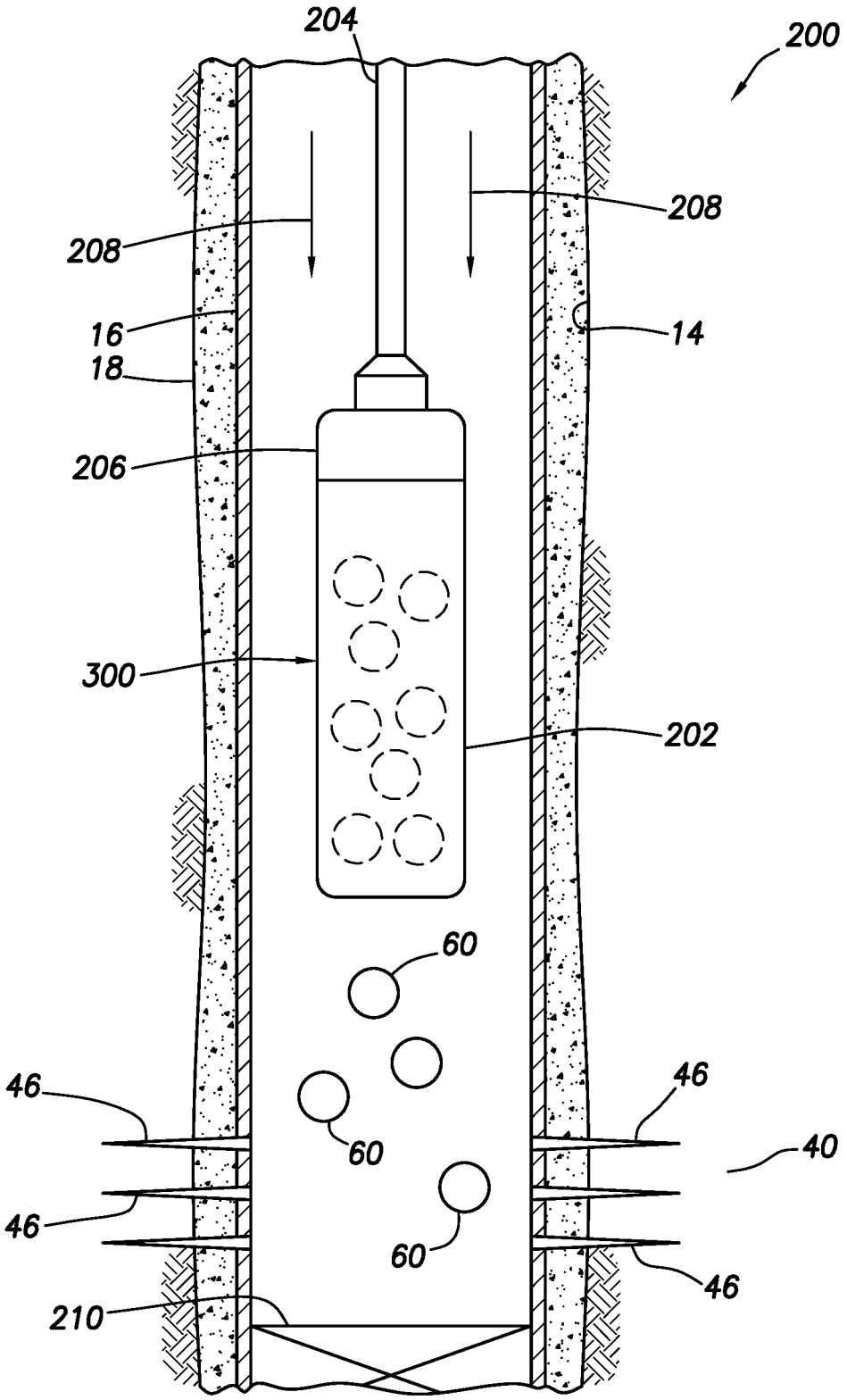
FIG. 14 is a representative partially cross-sectional view of a plugging device dispensing system that can embody the principles of this disclosure.

Referring additionally now to FIG. 14, a system 200 and associated method for dispensing the plugging devices 60 into the wellbore 14 is representatively illustrated. In this system 200, the plugging devices 60 are not discharged into the wellbore 14 at the surface and conveyed to a desired plugging location (such as perforations 38, 46*a-c*, 46 in the examples of FIGS. 2A-3D or the opening 68 in the example of FIGS. 6A & B) by fluid flow 44, 74, 96. Instead, the plugging devices 60 are contained in a container 202, the container is conveyed by a conveyance 204 to a desired downhole location, and the plugging devices are released from the container at the downhole location.

A variety of different containers 202 for the plugging devices 60 may be used. Thus, it should be clearly understood that the scope of this disclosure is not limited to any particular type or configuration of the container 202.

An actuator 206 may be provided for releasing or forcibly discharging the plugging devices 60 from the container 202 when desired. The container 202 and the actuator 206 may be combined into a dispenser tool 300 for dispensing the plugging devices 60 in the well at a downhole location. However, it is not necessary for an actuator to be provided, or for any particular type or configuration of actuator to be provided.

The conveyance 204 could be any type suitable for transporting the container 202 to the desired downhole location. Examples of conveyances include wireline, slickline, coiled tubing, jointed tubing, autonomous or wired tractor, etc.

In some examples, the container 202 could be displaced by fluid flow 208 through the wellbore 14. The fluid flow 208 could be any of the fluid flows 44, 74, 96 described above. The fluid flow 208 could comprise a treatment fluid, such as a stimulation fluid (for example, a fracturing and/or acidizing fluid), an inhibitor (for example, to inhibit formation of paraffins, asphaltenes, scale, etc.) and/or a remediation treatment (for example, to remediate damage due to scale, clays, polymer, etc., buildup in the well).

In the FIG. 14 example, the plugging devices 60 are released from the container 202 above a packer, bridge plug, wiper plug or other type of plug 210 previously set in the wellbore 14. In other examples, the plugging devices 60 could be released above a previously plugged valve, such as the valve 110 example of FIG. 13.

Note that it is not necessary in keeping with the scope of this disclosure for the plugging devices 60 to be released into the wellbore 14 above any packer, plug 210 or other flow blockage in the wellbore.

As depicted in FIG. 14, the plugging devices 60 will be conveyed by the flow 208 into sealing engagement with the perforations 46 above the plug 210. In other examples, the plugging devices 60 could block flow through other types of openings (e.g., openings in tubulars other than casing 16, flow passages in well tools such as the valve 110, etc.). Thus, the scope of this disclosure is not limited to use of the container 202 to release the plugging devices 60 for plugging the perforations 46.

The plugging devices 60 depicted in FIG. 14 are similar to those of the FIG. 11 example, and are spherically shaped. However, any of the plugging devices 60 described herein may be used with any of the system 200 and container 202 examples, and the scope of this disclosure is not limited to use of any particular configuration, type or shape of the plugging devices.

Although only release of the plugging devices 60 from the container 202 is described herein and depicted in the drawings, other plugging substances, devices or materials may also be released downhole from the container 208 (or another container) into the wellbore 14 in other examples. A material (such as, calcium carbonate, PLA or PGA particles) may be released from the container 208 and conveyed by the flow 208 into any gaps between the devices 60 and the openings to be plugged, so that a combination of the devices and the materials completely blocks flow through the openings.

Figure 15:
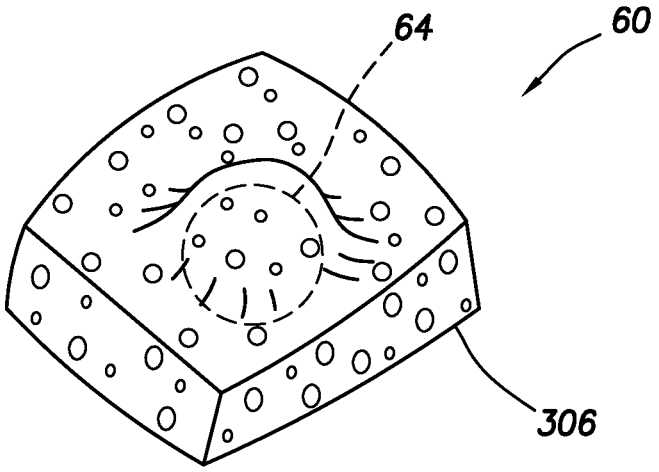
FIGS. 15 & 16 are representative views of additional plugging device embodiments having a relatively strong central member surrounded by a relatively low density material.
Figure 16:
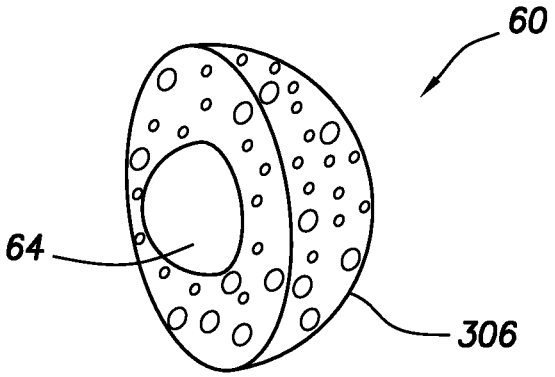

One use of the plugging devices 60 described herein is to block flow into or out of a perforation 46 during a fracturing operation. FIG. 15 depicts a plugging device 60 which is comprised of a central body 64 or member (such as a ball) which has enough strength to prevent extrusion through an opening 46 or 68 which is being blocked, and of an outer flexible, fluffy, or sponge-like material 306 which aids in directing the device 60 to a flow passage (such as perforation 46 or opening 68) and enhancing the ability of the device to seal an arbitrary shaped opening. FIG. 15 depicts a rectangular embodiment, and FIG. 16 depicts a spherical embodiment.

The central member or body 64 can be made of any degradable, self-degrading or non-degrading material (such as, any of the materials described herein) which has sufficient strength to prevent extrusion. The outer material 306 can comprise any suitable material (such as, open cell foam, fiber, fabric, sponge, etc.), whether degradable, self-degrading or non-degrading.

This device 60 can also be enclosed in a degradable retainer 80 or shell (such as, any of the retainers described herein), with or without a frangible coating 88 thereon. In one example, the device 60 can comprise a sponge-like, relatively low density outer material 306 compressed around a central, relatively high strength spherical body 64, until the retainer 80 dissolves, thereby allowing the foam-type or sponge-like material 306 to expand in a well.

Figure 17:
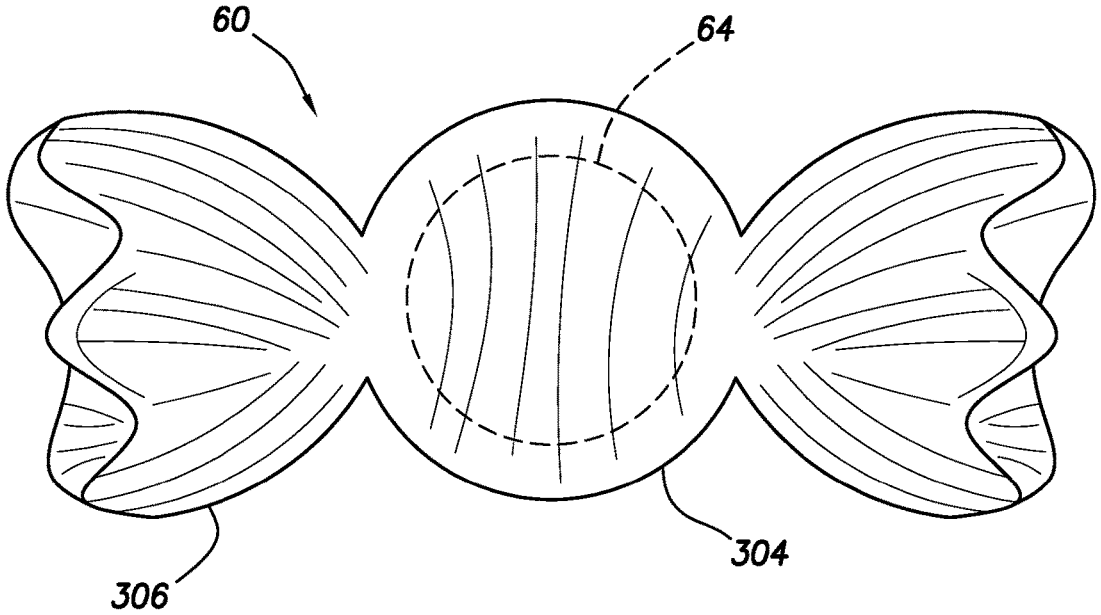
FIG. 17-37 are representative views of additional plugging device embodiments.

FIG. 17 depicts another embodiment in which a strong center member or body 64 contained within a wrapper, bag or other enclosure 304 of mesh, net, gauze, fabric, film, fiber or other fluffy or relatively low density outer material 306 that helps the device 60 find an opening 46, 68 through which fluid 74, 208 is flowing and assists in sealing the opening. The body 64 and the outer material 306 may comprise any of the materials described herein, whether degradable, self-degrading or non-degrading.

In the FIG. 17 example, the material 306 is in sheet form. The material 306 is wrapped about the body 64, and gathered on opposite sides of the body, in order to form the enclosure 304.

Note that the body 64 is, in this example, free to rotate and/or translate within the enclosure 304. There is no bonding or adhering between the body 64 and the enclosure 304, so that relative motion is permitted between the body and the enclosure. Sliding contact is permitted between the body 64 and the enclosure 304, with substantially no shear stress being supported at any point of contact between the body and the enclosure.

In other examples, the body 64 could be initially fixed to the enclosure 304 with a dissolvable or degradable binder (such as, polyvinyl alcohol or xanthan gum). Upon exposure to fluid in the well, the binder can dissolve or otherwise degrade, thereby permitting relative movement between the body 64 and the enclosure 304 downhole.

In further examples, the body 64 could be restricted in its range of movements relative to the enclosure 304. For example, the body 64 could be tethered to the enclosure 304, so that the body is confined to a particular area within the enclosure, while still being able to move relative to the enclosure.

Figure 18:
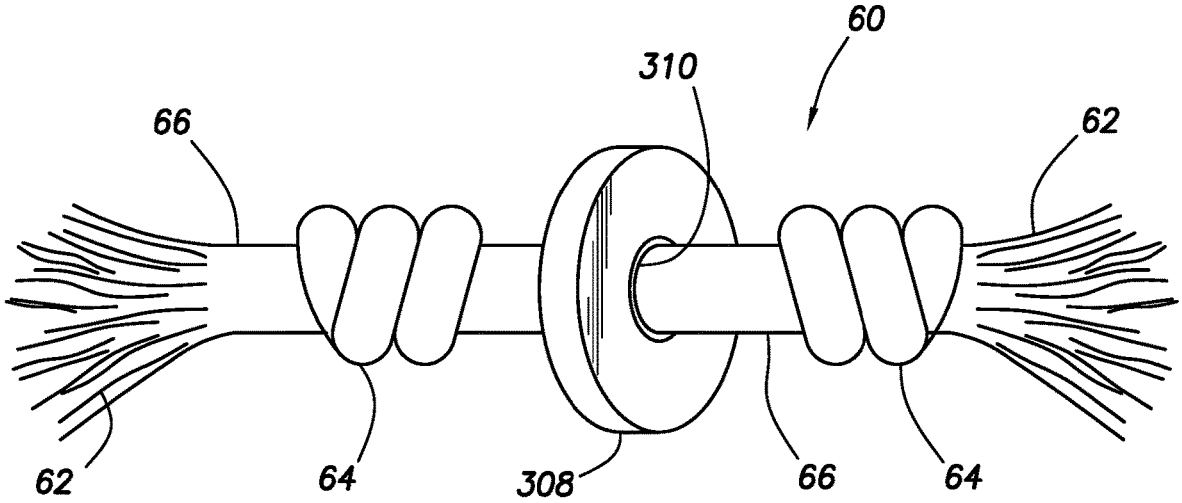

FIG. 18 depicts another embodiment of the device 60, which is comprised of a relatively strong disk-type or washer element 308 with the line 66 extending through a hole 310 in the disk-type or washer element 308. Near one or more ends of the line 66, a body 64 comprising a knot or other enlarged portion is present, which cannot pass through the hole 310 in the washer element 308.

The washer element 308 can comprise almost any shape or suitable material and the line 66 can comprise any pliable or otherwise suitable material (including, but not limited to, fibers 62, film, tubes, rope, fabric, filaments, mesh, etc.). In this example, the fibers 62 extending outwardly from each of the bodies 64 are very effective at "finding" an opening 46, 68 to be plugged and the body 64 "knots" are sized such that they can pass into or through the opening to be plugged.

One end of the knotted line 66 will follow flow and pass through the opening, causing the washer element 308 to be drawn up against the wall surrounding the opening 46, 68. The body 64 knot at the other end of the line 66 will plug the center hole 310 in the washer element 308 causing it to be tightly sealed by pressure against the wall surrounding the opening 46, 68.

The washer element 308 can be coated with elastomer or other suitable material to aid in sealing. Any or all portions of this device 60 can be made of degradable or self-degrading material, if desired. Any of these plugging devices 60 can be packaged as described above in a frangible outer shell, coating 88 and/or retainer 80.

Referring additionally now to FIGS. 19-37, a variety of different plugging device 60 example configurations are representatively illustrated. These plugging devices 60 may be used in any of the system or method examples described herein, may be constructed using any of the materials (including but not limited to dissolvable, dispersible or degradable materials) described herein, and may be formed of any structural components (such as, lines, ropes, tubes, filaments, films, fabrics, meshes, weaves, fibers, etc.) described herein. The scope of this disclosure is not limited to any particular configurations, materials, structures, components or other details of the plugging devices 60 as depicted in the drawings or described herein.

In each of the FIGS. 19-37 examples, threads or fibers 62 may protrude or extend outwardly from a central body 64, or from one or more ropes or lines 66 extending outwardly from the body 64. The fibers 62 and lines 66 can help to convey the body 64 by fluid flow toward a perforation 46, opening 68 or other passageway, due to enhanced drag. The fibers 62 and lines 66 can also improve sealing of imperfectly shaped holes, perforations, openings and passageways.

The examples of FIGS. 19, 20, 22, 23, 25 & 26 utilize a wrap, band or other type of binding 312 to secure together multiple fibers 62 or lines 66. The binding 312 may also provide structural support to the body 64, or form a part of the body 64, for example, to prevent it from extruding through a perforation 46, opening 68 or other passageway.

The binding 312 in any of these examples may comprise heat or chemical fusing, or glue, adhesive or other type of bonding. Any combination of banding, fusing, or bonding may be used.

Figure 19:
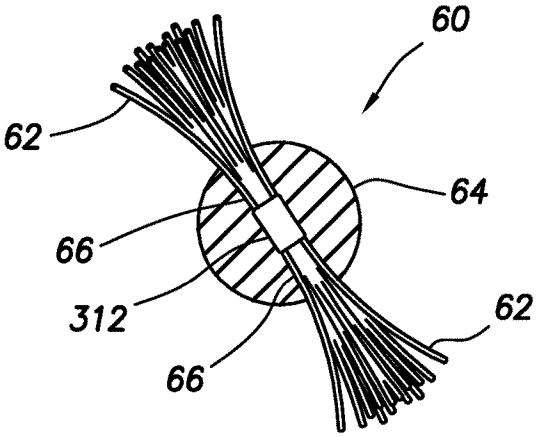

In the FIG. 19 example, a group of fibers 62 are banded together with the binding 312. A spherical body 64 (depicted in cross-section in FIG. 19) is molded or otherwise formed about the binding 312.

In this example, and in the other examples described herein, bundles of the fibers 62 may be secured with the binding 312, or the fibers 62 may be comprised of ropes or other lines 66 that are secured with the binding 312 (as in the FIG. 19 example). The fibers 62 may be splayed outward at their ends facing away from the body 64.

Figure 20:
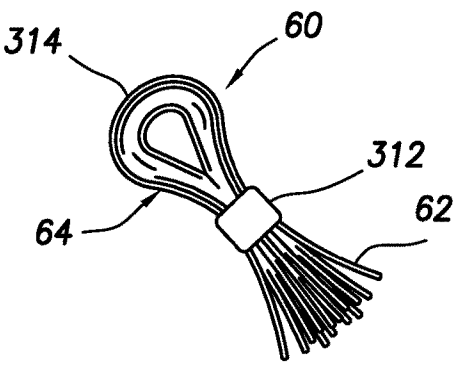

In the FIG. 20 example, a loop 314 is formed from multiple fibers 62, with the binding 312 securing the fibers together near a middle of the fibers' length.

Figure 21:
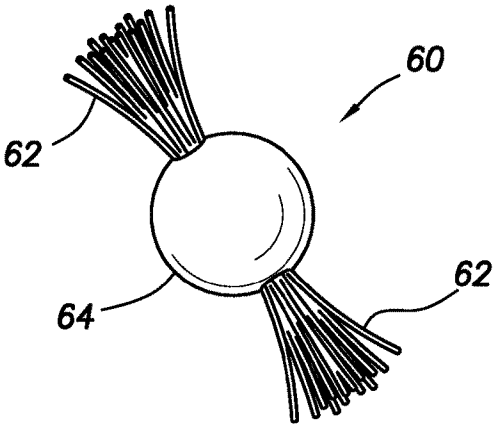

In the FIG. 21 example, the fibers 62 are fused, adhered or bonded to an outer surface of a spherically shaped body 64. Of course, in any examples described herein in which the body 64 is depicted as being spherical, the body could have other shapes (such as, oblong, oval, cubic, rectangular, combinations of shapes, etc.).

Figure 22:
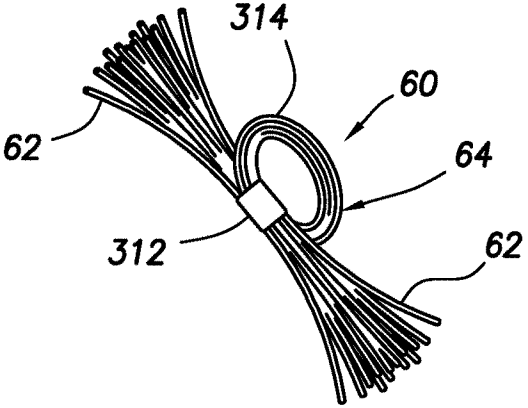

In the FIG. 22 example, the fibers 62 are secured together in a loop 314 with the binding 312, similar to the FIG. 20 example. However, in the FIG. 22 example, the fibers 62 extend in opposite directions from the binding 312.

Figure 23:
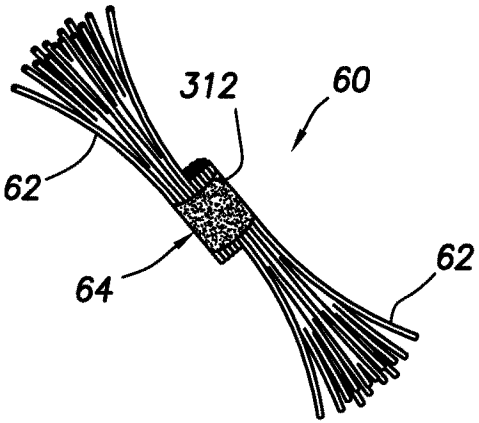

In the FIG. 23 example, the fibers 62 are fused or bonded together, or secured with a binding 312. However, some of the fibers 62 are shortened on opposite sides of the binding 312 (or fusing or bonding), so that the body 64 (comprising the binding and ends of the fibers) has a larger outer dimension, as compared to the groups of fibers 62 extending in opposite directions from the body.

Figure 24:
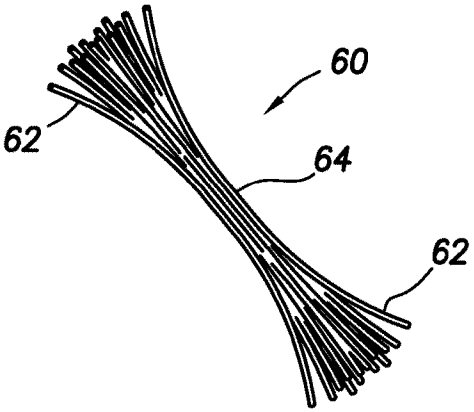

In the FIG. 24 example, the fibers 62 are fused or bonded together at or near a middle of the fibers. A binding 312 may be used to secure the fibers 62 together in other examples.

Figure 25:
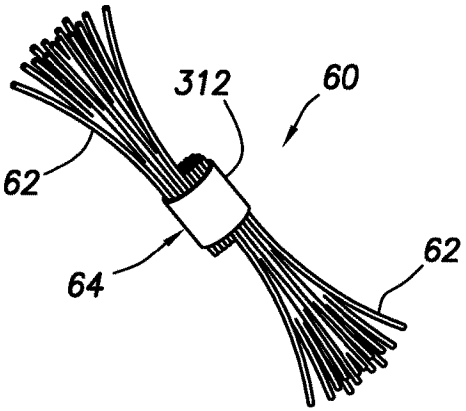

In the FIG. 25 example, the binding 312 is substantially strengthened, so that it forms a structural support of the body 64. The binding 312 itself may engage and block flow through a perforation 46, opening 68 or other passageway in a well.

Figure 26:
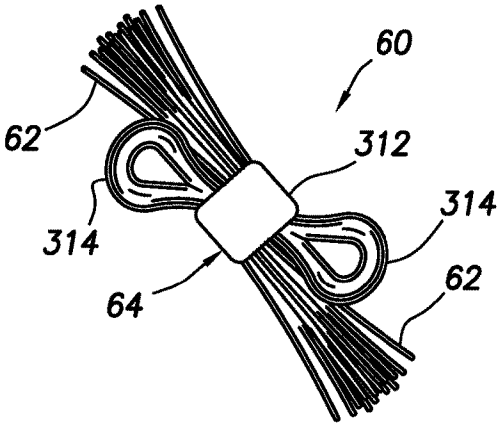

In the FIG. 26 example, a binding 312 is used to secure loops 314 in the fibers 62, similar to the FIGS. 20 & 22 examples. There are multiple loops 314 in the FIG. 26 example, with the loops and the fibers 62 extending outwardly from the body 64 in opposite directions.

Figure 27:
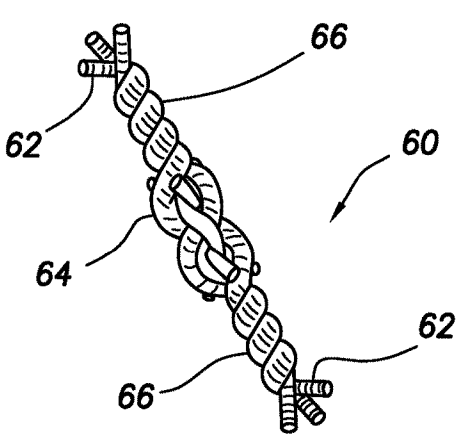

In the FIG. 27 example, the lines 66 comprise ropes, ends of which are spliced together, e.g., by weaving. The woven splice creates an enlarged outer dimension of the body 64. In other examples, items such as an eye or braided end could be used.

Figure 28:
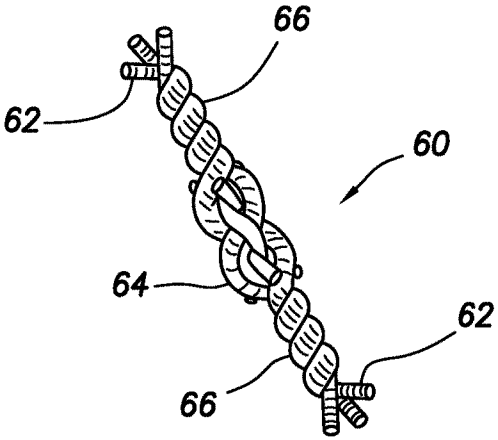

In the FIG. 28 example, the lines 66 comprise ropes, somewhat similar to the FIG. 27 example. However, in the FIG. 28 example, the ropes are braided from many strands, with some of the strands being cut and removed to create a "bulge" in the middle and form the body 64.

Figure 29:
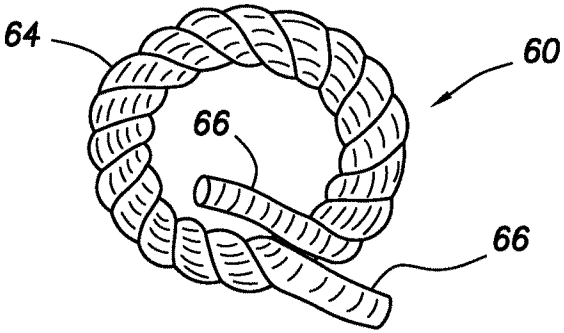

In the FIG. 29 example, a rope grommet forms a circular body 64. The rope grommet body 64 may be provided with or without splayed ends (e.g., individual fibers 62) of the lines 66 extending outwardly from the body.

Figure 30A:
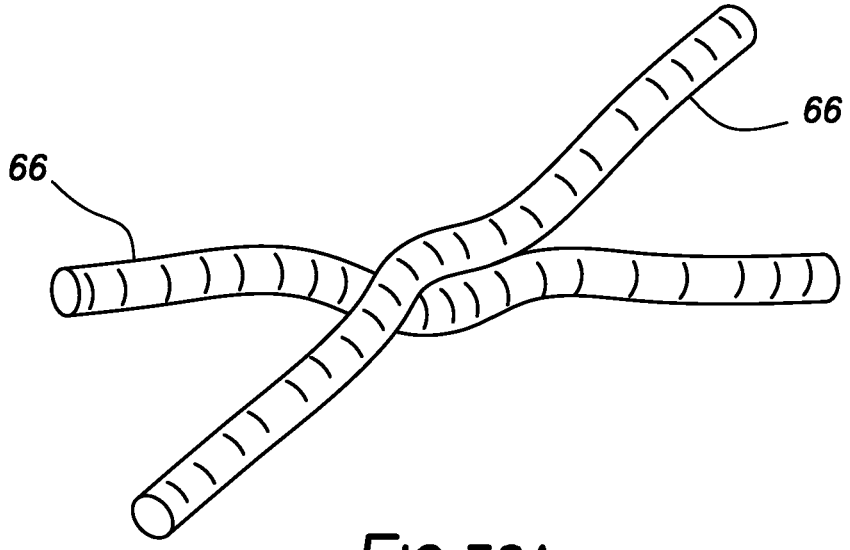
Figure 30B:
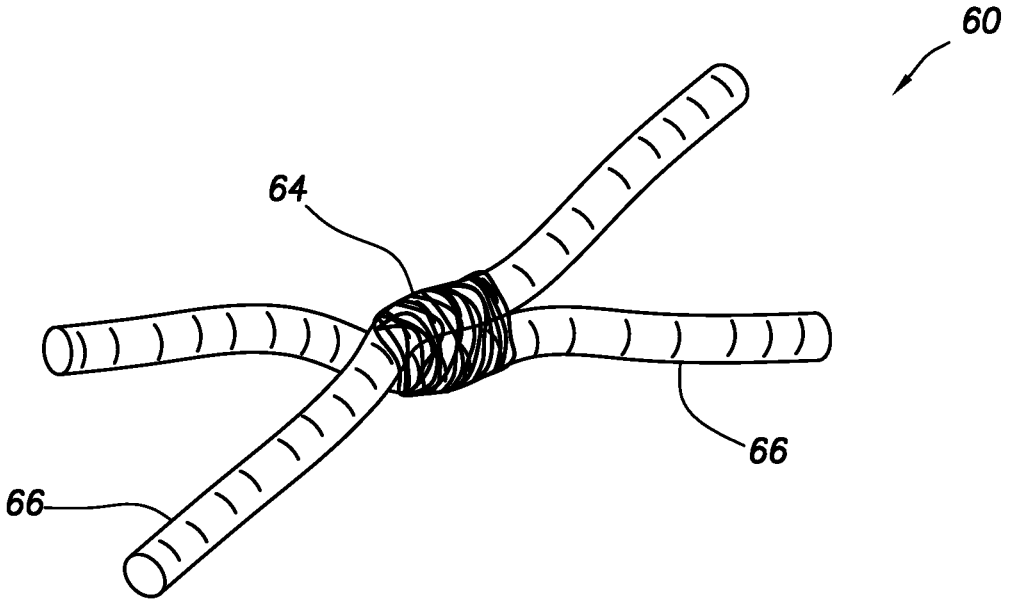

In the FIGS. 30A & B example, two or more lines 66 (e.g., ropes, fiber bundles, strings, string bundles, etc.) may be fused or bonded to each other. As depicted in FIG. 30A, lines 66 are arranged in crossing contact before fusing. As depicted in FIG. 30B, the lines 66 are then fused or bonded to each other where they contact.

A cross-sectional area of the fused-together lines 66 (or fiber 62 bundles, etc.) forms the body 64, which has a larger outer dimension than each of the lines 66 extending outwardly from the body. Binding, gluing, bonding or other securement means can also, or alternatively, be used.

Figure 31:
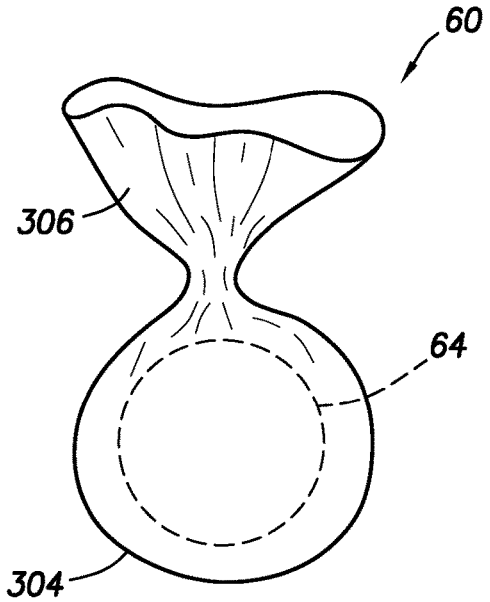

In the FIG. 31 example, the plugging device 60 is constructed similar to the example of FIG. 17. The material 306 in the FIG. 31 example comprises a sheet that is wrapped about the body 64 and gathered together on one side of the body, instead of on opposite sides of the body (as in the FIG. 17 example).

Note that the body 64 is (in the FIG. 31 example and the FIGS. 32-34 examples described below) free to rotate and/or translate within the enclosure 304. There is no bonding or adhering between the body 64 and the enclosure 304, so that relative motion is permitted between the body and the enclosure. Sliding contact is permitted between the body 64 and the enclosure 304, with substantially no shear stress being supported at any point of contact between the body and the enclosure.

In other examples, the body 64 could be initially fixed to the enclosure 304 with a dissolvable or degradable binder (such as, polyvinyl alcohol or xanthan gum), or the body 64 could be restricted in its range of movements relative to the enclosure 304 (e.g., the body 64 could be tethered to the enclosure 304, so that the body is confined to a particular area within the enclosure, while still being able to move relative to the enclosure).

Figure 32:
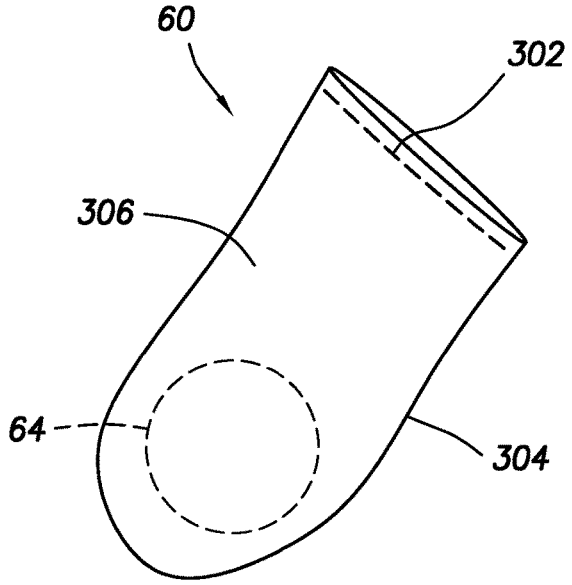

In the FIG. 32 example, the enclosure 304 has a tubular or "sock" shape, with an end of the enclosure being closed by stitching 302. The stitching 302 could be replaced by adhesive, fusing, bonding or other closure means. The enclosure 304 may be formed in the tubular shape by weaving the material 306 with one end closed, inserting the body 64 therein, and then closing the other end (for example, by stitching 302 or other closure means). In another example, a sheet of the material 306 could be rolled into a tubular shape with ends thereof closed on opposite sides of the body 64.

Figure 33:
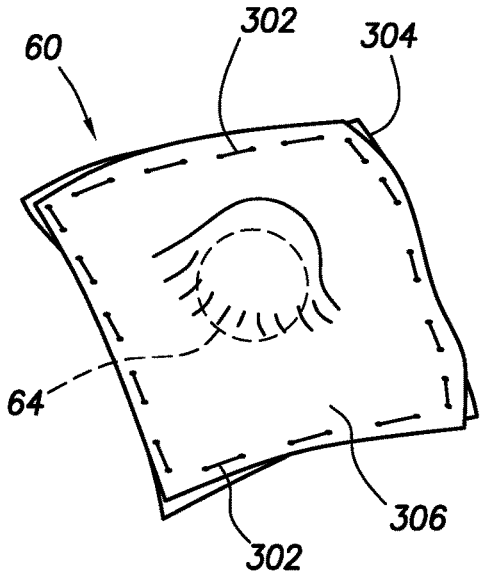

In the FIG. 33 example, the enclosure comprises two sheets of the material 306, stitched together around their peripheries, and with the body 64 enclosed between the sheets of the material. The FIG. 34 example is similar to the FIG. 33 example, but the FIG. 34 example comprises a single sheet of the material 306, folded over the body 64, and stitched around its periphery.

Figure 34:
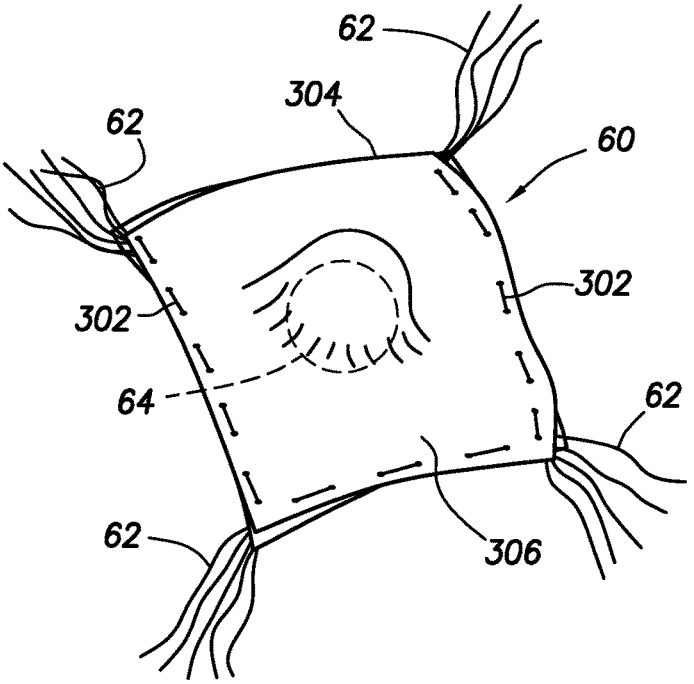

In addition, the FIG. 34 example includes fibers 62, filaments or tubes extending outwardly from the enclosure 304. The fibers 62, filaments or tubes may be used to enhance fluid drag on the plugging device 60.

Note that any of the plugging devices 60 described herein can include the fibers 62, filaments, tubes, etc. extending outwardly from the body 64, the retainer 80 or the enclosure 304. The fibers 62, filaments or tubes may be grouped into bundles or lines 66, or positioned individually or randomly. The fibers 62, filaments or tubes may be attached in any manner, such as, by adhering, fusing, bonding, binding, stitching, tying, integrally forming, etc.

Figure 35:
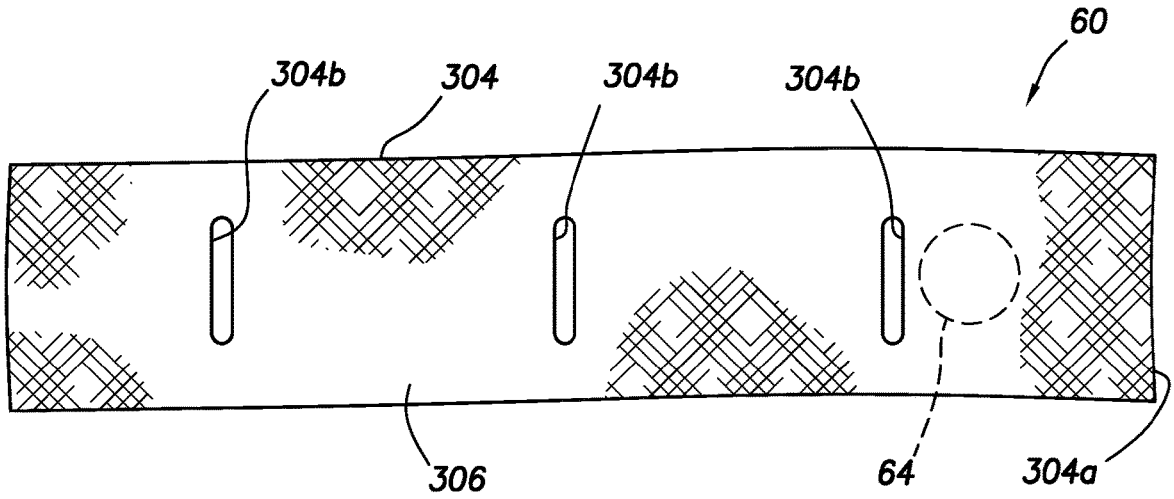
Figure 36:
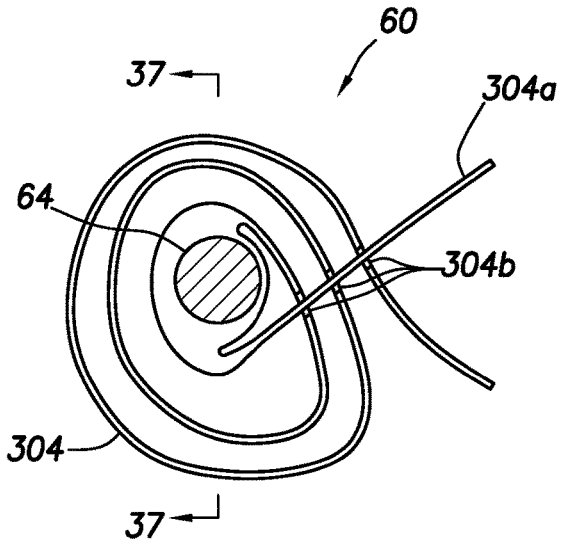
Figure 37:
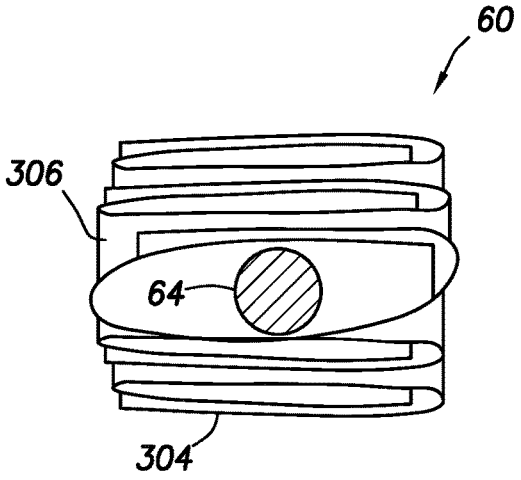

In the FIGS. 35-37 example, the body 64 is enclosed in a sheet of the material 306 folded around the body. The folded material 306 is then rolled around the body 64, with an end 304*a* of the enclosure 304 being inserted through a slot 304*b* in the material 306 for each wrap about the body 64. FIG. 37 is taken along line 37-37 of FIG. 36.

In each of the FIGS. 17 and 31-37 examples, the body 64 may comprise a material that is sufficiently strong and rigid to engage and block fluid flow through an opening 68 perforation 46 or other passageway, without undesirably extruding through the passageway. Some extrusion may be desirable, however, for enhanced sealing and conforming to a shape of the passageway. The enclosure material 306 may comprise a relatively less dense material and/or a material with relatively large drag in well fluid. The enclosure 304 may be configured (sized, shaped, etc.) so that it effectively fills and prevents fluid flow through any gaps between the plugging device 60 and the passageway.

In any of the examples described herein, the fibers 62, lines 66 or body 64, or any combination thereof, may comprise a material that is capable of hardening or becoming more rigid in a well. In this manner, a plugging device 60 can more capably resist extrusion through a perforation 46, opening 68 or other passageway downhole.

The plugging device 60, or any component thereof (such as, the body 64, lines 66, fibers 62, binding 312, retainer 80, retainer material 82, coating 88, enclosure 304, etc.), may begin "setting" (becoming harder or more rigid) before, during, or after it is introduced into a well or released downhole. The hardening, rigid-izing or setting may result from polymerizing, hydrating, cross-linking or other process by which a material of the plugging device 60 becomes harder, stronger or more rigid. The plugging device 60, or any component thereof, may begin setting before, during, or after it engages a perforation 46, opening 68 or other passageway downhole.

The plugging device 60, or any component thereof, may set in response to any stimulus or condition, including but not limited to, passage of time, contact with an activating chemical, fluid or other substance, exposure to elevated temperature, exposure to a certain pH level, exposure to the well environment. In cases where the setting occurs in response to contact with an activating chemical, fluid or other substance, the chemical, fluid or substance could be injected into the well, or released from a downhole container, at any time (such as, before, during or after the plugging devices 60 are introduced into the well, released downhole or engaged with a perforation 46, opening 68 or other passageway).

Another way in which the plugging devices 60 may "set" downhole is by swelling. For example, a plugging device 60 or any of its components (such as, the body 64, lines 66, fibers 62, binding 312, retainer 80, retainer material 82, coating 88, enclosure 304, etc.) could comprise a swellable material that swells (e.g., swellable rubber strands could be mixed with structural materials such as nylon, polyester etc.), so that the plugging device more effectively seals off a perforation 46, opening 68 or other passageway. Similar to the hardening, strengthening or rigid-izing discussed above, the swelling could be initiated at any time, and could occur in response to any appropriate stimulus or condition.

It may now be fully appreciated that the above disclosure provides significant advancements to the art of controlling flow in subterranean wells. In some examples described above, the plugging device 60 may be used to block flow through openings in a well, with the device being uniquely configured so that its conveyance with the flow is enhanced and/or its sealing engagement with an opening is enhanced.

The above disclosure provides to the art a plugging device 60 for use in a subterranean well. In one example, the plugging device 60 can comprise a body 64 configured to engage and substantially block flow through a passageway (such as, a perforation 46 or opening 68) in the well, and an enclosure 304 containing the body 64, relative motion being permitted between the body 64 and the enclosure 304.

The relative motion may include at least one of rotation and translation. Shear stress may be substantially unsupported in sliding contact between the body 64 and the enclosure 304. The enclosure 304 may not be attached or bonded to the body 64.

The relative motion between the body 64 and the enclosure 304 may be limited. The body 64 may be tethered to the enclosure 304. The body 64 may be initially fixed relative to the enclosure 304 with a degradable binder.

The body 64 and/or the enclosure 304 may comprise a material that degrades in the well. The enclosure 304 may comprise a material 306 in sheet form wrapped or rolled about the body 64.

The enclosure 304 may comprise a material 306 in tubular form, the body 64 being received in the tubular form. The enclosure 304 may comprise a material 306 with the body 64 enclosed therein by stitching 302.

The body 64 may be more rigid and more dense relative to the enclosure 304.

A method of plugging a passageway (such as, the perforation 46 or opening 68) is also provided to the art by the above disclosure. In one example, the method can comprise: releasing a plugging device 60 into a fluid flow 44, 52, 74, 96, 208, thereby causing the plugging device to be carried by the fluid flow 44, 52, 74, 96, 208 to the passageway, the plugging device 60 comprising a body 64 enclosed by an enclosure 304, and relative motion being permitted between the body 64 and the enclosure 304; and the plugging device 60 engaging the passageway and thereby blocking the passageway.

The relative motion between the body 64 and the enclosure 304 may be permitted prior to, or only after, the releasing step.

The blocking step may include the enclosure 304 sealing between the body 64 and the passageway.

The method may include forming the body 64 relatively more rigid and more dense compared to the enclosure 304.

The method may include a material of the body 64 and/or a material 306 of the enclosure 304 degrading in the well.

The method may include forming the enclosure 304 by wrapping or rolling a material 306 in sheet form about the body 64.

The method may include forming the enclosure 304 of a material 306 in tubular form, the body 64 being received in the tubular form.

The method may include forming the enclosure 304 by enclosing the body 64 within a material 306 by stitching 302.

Also described above is a well system 10. In one example, the well system 10 can comprise a plugging device 60 conveyed through a tubular string 72 by fluid flow 74 in the well, the plugging device 60 comprising a body 64 contained within an enclosure 304, the body 64 being configured to engage and resist extrusion through a passageway (such as, the perforation 46 or opening 68) in the well, the enclosure 304 being configured to block the fluid flow 74 between the plugging device 60 and the passageway, and sliding contact being permitted between the body 64 and the enclosure 304.

A plugging device 60, well system 10 and associated method may utilize a wrap, band or other type of binding 312 to secure together multiple fibers 62, tubes, filaments, films, fabrics or lines 66. The binding 312 may provide structural support to a body 64 of the plugging device 60, or form a part of the body 64.

The binding 312 may prevent the plugging device 60 from extruding through a perforation 46, opening 68 or other passageway. The binding 312 may comprise heat or chemical fusing, or glue, adhesive or other type of bonding.

A spherical body 64 may be molded or otherwise formed about the binding 312. One or more loop 314 may be formed from multiple fibers 62, tubes, filaments, films, fabrics or lines 66.

The fibers 62 may extend in opposite directions from the binding 312. The binding 312 may secure the fibers 62, tubes, filaments, films, fabrics or lines 66 together near a middle of a length of the fibers, tubes, filaments, films, fabrics or lines.

A plugging device 60, well system 10 and associated method may comprise fibers 62, tubes, filaments, films, fabrics or lines 66 that are fused, adhered or bonded to an outer surface of a body 64 of the plugging device 60. The body 64 may have a spherical, oblong, oval, cubic or rectangular shape, or a combination of shapes.

A plugging device 60, well system 10 and associated method may comprise fibers 62, tubes, filaments, films, fabrics or lines 66 that are fused or bonded together, or secured with a binding 312, some of the fibers 62, tubes, filaments, films, fabrics or lines 66 being shortened on opposite sides of the binding 312 (or fusing or bonding). The body 64 (comprising the binding 312 (or fusing or bonding) and ends of the fibers 62) can have a larger outer dimension, as compared to the groups of fibers 62, tubes, filaments, films, fabrics or lines 66 extending in opposite directions from the body 64.

A plugging device 60, well system 10 and associated method may comprise a binding 312 that is substantially strengthened, so that it forms a structural support of a body 64 of the plugging device 60. The binding 312 may engage and block flow through a perforation 46, opening 68 or other passageway in a well.

A plugging device 60, well system 10 and associated method may include lines 66 of the plugging device 60 comprising ropes, ends of which are spliced together, such as, by weaving. The woven splice creates an enlarged outer dimension of a body 64 of the plugging device 60. The body 64 of the plugging device 60 may comprise an eye or braided end of the ropes.

A plugging device 60, well system 10 and associated method may include lines 66 of the plugging device 60 comprising ropes braided from multiple strands, with some of the strands being cut and removed to create a "bulge" in the middle and form a body 64 of the plugging device 60.

A plugging device 60, well system 10 and associated method may comprise a rope grommet forming a circular body 64 of the plugging device 60. The rope grommet body 64 may be provided with or without splayed ends of the lines 66 extending outwardly from the body 64.

A plugging device 60, well system 10 and associated method may comprise two or more lines 66, ropes, fiber 62 bundles, strings or string bundles that are fused, bound, glued or bonded to each other. The lines 66, ropes, fiber bundles, strings or string bundles may be arranged in crossing contact before fusing, binding, gluing or bonding. The lines 66, ropes, fiber 62 bundles, strings or string bundles may be fused, bound, glued or bonded to each other where they contact.

A cross-sectional area of the secured-together lines 66, ropes, fiber 62 bundles, strings or string bundles may form a body 64 of the plugging device 60. The body 64 of the plugging device 60 may have a larger outer dimension than each of the lines 66, ropes, fiber 62 bundles, strings or string bundles extending outwardly from the body 64.

A plugging device 60, well system 10 and associated method can include at least one component of the plugging device 60 comprising a material that is capable of hardening or becoming more rigid in a well. The more rigid or hardened component resists extrusion through a perforation 46, opening 68 or other passageway downhole.

The plugging device 60, or any component thereof, may begin becoming harder or more rigid before, during, or after it is introduced into a well or released downhole. The plugging device 60, or any component thereof, may begin setting before, during, or after it engages a perforation 46, opening 68 or other passageway downhole.

The plugging device 60, or any component thereof, may set in response to any stimulus or condition, including but not limited to, passage of time, contact with an activating chemical, fluid or other substance, exposure to elevated temperature, exposure to a certain pH level or exposure to the well environment. The setting may occur in response to contact with an activating chemical, fluid or other substance. The chemical, fluid or substance may be injected into the well, or released from a downhole container 202, at any time (such as, before, during or after the plugging devices 60 are introduced into the well, released downhole or engaged with a perforation 46, opening 68 or other passageway).

A plugging device 60, well system 10 and associated method may include the plugging device 60, or any component thereof, which swells in the well. The plugging device 60 or any of its components may comprise a swellable material that swells (e.g., swellable rubber strands could be mixed with structural materials such as nylon, polyester etc.), so that the plugging device 60 more effectively seals off a perforation 46, opening 68 or other passageway.

The swelling may be initiated at any time (such as, before, during or after the plugging devices 60 are introduced into the well, released downhole or engaged with a perforation 46, opening 68 or other passageway). The swelling may occur in response to any appropriate stimulus or condition, including but not limited to, passage of time, contact with an activating chemical, fluid or other substance, exposure to elevated temperature, exposure to a certain pH level or exposure to the well environment.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A plugging device, comprising:

a body configured to engage and block fluid flow through a passageway in a subterranean well; and a binding which outwardly surrounds multiple fibers, tubes, filaments, films, fabrics or lines and secures together the fibers, tubes, filaments, films, fabrics or lines into at least one bundle which extends outwardly from the body, in which the plugging device is configured to be conveyed by the fluid flow through the well to the passageway.

2. The plugging device of claim 1, in which the binding provides structural support to the body of the plugging device, or forms a part of the body.

3. The plugging device of claim 1, in which the binding prevents the plugging device from extruding through the passageway.

4. The plugging device of claim 1, in which the body is molded or otherwise formed about the binding.

5. The plugging device of claim 1, in which at least one loop is formed from the fibers, tubes, filaments, films, fabrics or lines.

6. The plugging device of claim 1, in which the fibers, tubes, filaments, films, fabrics or lines extend in opposite directions from the binding.

7. The plugging device of claim 6, in which the binding secures the fibers, tubes, filaments, films, fabrics or lines together at a middle of the fibers', tubes', filaments', films', fabrics' or lines' length.

8. The plugging device of claim 1, in which some of the fibers, tubes, filaments, films, fabrics or lines are shortened on opposite sides of the binding.

9. The plugging device of claim 1, in which the body has a larger outer dimension, as compared to the fibers, tubes, filaments, films, fabrics or lines.

10. The plugging device of claim 1, in which the binding forms a structural support of the body of the plugging device.

11. The plugging device of claim 1, in which the binding engages and blocks flow through the passageway in the well.

12. The plugging device of claim 1, in which ends of the fibers, tubes, filaments, films, fabrics or lines are splayed outwardly.

13. The plugging device of claim 1, in which the plugging device, or any component thereof, swells in the well.

14. The plugging device of claim 13, in which the plugging device or any of its components comprises a swellable material that swells so that the plugging device seals off the passageway.

15. The plugging device of claim 13, in which the swelling is initiated at any time.

16. The plugging device of claim 13, in which the swelling occurs in response to passage of time, contact with an activating chemical, fluid or other substance, exposure to elevated temperature, exposure to a certain pH level or exposure to conditions within the well.

17. A plugging device, comprising:

a body configured to engage and block fluid flow through a passageway in a subterranean well, in which the plugging device is configured to be conveyed by the fluid flow through the well to the passageway; and at least one rope, ends of which are spliced together.

18. The plugging device of claim 17, in which the spliced ends create an enlarged outer dimension of the body of the plugging device.

19. The plugging device of claim 17, in which the body of the plugging device comprises an eye or braided end of the at least one rope.

20. The plugging device of claim 17, in which a rope grommet forms the body of the plugging device.

21. A plugging device, comprising:

a body configured to engage and block fluid flow through a passageway in a subterranean well, in which the plugging device is configured to be conveyed by the fluid flow through the well to the passageway; and at least one rope braided from multiple strands, with some of the strands being cut and removed to create an enlarged portion which forms the body of the plugging device.

22. A plugging device, comprising:

a body configured to engage and block fluid flow through a passageway in a subterranean well; and multiple fibers, tubes, filaments, films, fabrics or lines bonded into at least one bundle which extends outwardly from the body, in which the plugging device is configured to be conveyed by the fluid flow through the well to the passageway, and in which the fibers, tubes, filaments, films, fabrics or lines are thermally or chemically fused to each other.

23. The plugging device of claim 22, in which the fibers, tubes, filaments, films, fabrics or lines are fused, adhered or bonded to an outer surface of the body of the plugging device.

24. The plugging device of claim 23, in which the body comprises spherical, oblong, oval, cubic, rectangular or combinations of shapes.

25. The plugging device of claim 22, in which the fibers, tubes, filaments, films, fabrics or lines are arranged in crossing contact before fusing.

26. The plugging device of claim 25, in which the fibers, tubes, filaments, films, fabrics or lines are fused to each other where they contact.

27. The plugging device of claim 22, in which the body of the plugging device comprises a region where the multiple fibers, tubes, filaments, films, fabrics or lines are fused to each other.

28. The plugging device of claim 22, in which the body of the plugging device has a larger outer dimension than the at least one bundle.

29. A plugging device, comprising:

a body configured to engage and block fluid flow through a passageway in a subterranean well; and a binding which secures together multiple fibers, tubes, filaments, films, fabrics or lines into at least one bundle which extends outwardly from the body, in which the plugging device is configured to be conveyed by the fluid flow through the well to the passageway, and in which at least one component of the plugging device comprises a material that is adapted to harden in the well.

30. The plugging device of claim 29, in which the component resists extrusion through the passageway downhole.

31. The plugging device of claim 29, in which the plugging device, or any component thereof, begins becoming harder before, during, or after the plugging device is introduced into the well or released downhole.

32. The plugging device of claim 29, in which the plugging device, or any component thereof, begins hardening before, during, or after the plugging device engages the passageway downhole.

33. The plugging device of claim 29, in which the plugging device, or any component thereof, hardens in response to passage of time, contact with an activating chemical, fluid or other substance, exposure to elevated temperature, exposure to a certain pH level or exposure to the well environment.

34. The plugging device of claim 29, in which the hardening occurs in response to contact with an activating chemical, fluid or other substance, and the chemical, fluid or substance is injected into the well, or released from a downhole container, at any time.

* * * * *